US012428808B2

(12) United States Patent
Sato et al.

(10) Patent No.: US 12,428,808 B2
(45) Date of Patent: Sep. 30, 2025

(54) HYDRAULIC DEVICE, HYDRAULIC MOTOR AND CONSTRUCTION MACHINE

(71) Applicant: NABTESCO CORPORATION, Tokyo (JP)

(72) Inventors: Masataka Sato, Tokyo (JP); Etsuro Komori, Tokyo (JP)

(73) Assignee: NABTESCO CORPORATION, Tokyo (JP)

( * ) Notice: Subject to any disclaimer, the term of this patent is extended or adjusted under 35 U.S.C. 154(b) by 0 days.

(21) Appl. No.: 18/495,327

(22) Filed: Oct. 26, 2023

(65) Prior Publication Data

US 2024/0175239 A1 May 30, 2024

(30) Foreign Application Priority Data

Nov. 24, 2022 (JP) ..... 2022-187402

(51) Int. Cl.
*E02F 9/12* (2006.01)
*E02F 9/20* (2006.01)
(Continued)

(52) U.S. Cl.
CPC ..... *E02F 9/128* (2013.01)

(58) Field of Classification Search
CPC ..... E02F 9/128; E02F 9/2083; E02F 9/2246; E02F 9/2264; F04C 2/103; F04C 15/0084;
(Continued)

(56) References Cited

U.S. PATENT DOCUMENTS 9,175,563 B2 * 11/2015 Attarde ..... F04C 15/0084
10,781,816 B2 * 9/2020 Patil ..... F16D 55/42
(Continued)

FOREIGN PATENT DOCUMENTS

EP 1070847 A2 1/2001
JP 2011-220341 A 11/2011

OTHER PUBLICATIONS

Extended European Search Report dated Apr. 23, 2024, issued in corresponding European Patent Application No. 23206055.8 (8 pgs.).

*Primary Examiner* — Dapinder Singh
(74) *Attorney, Agent, or Firm* — Pillsbury Winthrop Shaw Pittman, LLP

(57) ABSTRACT

A hydraulic device includes: a first block having internal teeth; a second block configured to rotate relative to the first block; an oscillatory rotating body having external teeth smaller in number than the internal teeth, being provided inside the first block such that it is oscillatorily rotatable, and having an inner circumferential portion; a rotation restricting shaft extending from the inner circumferential portion of the oscillatory rotating body in a direction intersecting a radial direction and coupling the oscillatory rotating body and the second block such that they are not allowed to rotate relative to each other while allowing the oscillatory rotating body to oscillatorily rotate; a first friction plate configured to rotate together with the oscillatory rotating body; a second friction plate restricted from rotating by the second or first block; and a press mechanism configured to press the first and second friction plates against each other.

11 Claims, 16 Drawing Sheets

(51) Int. Cl.

| | |
|---|---|
| ***E02F 9/22*** | (2006.01) |
| ***F03C 2/08*** | (2006.01) |
| ***F03C 4/00*** | (2006.01) |
| ***F04C 2/10*** | (2006.01) |
| ***F15B 11/16*** | (2006.01) |
| ***F15B 13/06*** | (2006.01) |
| ***F15B 15/26*** | (2006.01) |

(58) Field of Classification Search
CPC .. F03C 2/08; F15B 11/16; F15B 13/06; F15B 15/262; F15B 2211/3052; F15B 2211/30525; F15B 2211/6333; F15B 2211/715
See application file for complete search history.

(56) References Cited

U.S. PATENT DOCUMENTS

| | | | | |
|---|---|---|---|---|
| 2006/0159581 | A1* | 7/2006 | Fugle | F04C 15/0084 418/61.3 |
| 2010/0178188 | A1* | 7/2010 | White, Jr. | F03C 2/02 418/61.3 |
| 2011/0017059 | A1* | 1/2011 | Heren | F03C 1/0425 91/491 |

* cited by examiner

HYDRAULIC DEVICE, HYDRAULIC MOTOR AND CONSTRUCTION MACHINE

CROSS-REFERENCE TO RELATED APPLICATIONS

This application is based on and claims the benefit of priority from Japanese Patent Application Serial No. 2022-187402 (filed on Nov. 24, 2022), the contents of which are hereby incorporated by reference in its entirety.

TECHNICAL FIELD

The present invention relates to a hydraulic device, a hydraulic motor and a construction machine.

BACKGROUND

Hydraulic motors may be used in construction machines as the drive source of the traveling drive unit. Among such hydraulic motors used as a drive source, a known hydraulic motor includes a tubular member, an oscillatory rotating body and a plurality of working chambers. The oscillatory rotating body is arranged inside the tubular member and rotatable relative to the tubular member. The working chambers are defined between the tubular member and the oscillatory rotating body and configured to sequentially receive and release a hydraulic fluid.

The tubular member of the hydraulic motor has a plurality of internal teeth on the inner periphery. The outer circumferential surface of the oscillatory rotating body has a plurality of external teeth. The number of the external teeth of the oscillatory rotating body is less than that of the internal teeth of the tubular member. For example, the external teeth are smaller in number by one than the internal teeth. The internal teeth are engaged and in contact with the external teeth of the oscillatory rotating body. In this manner, the working chambers are defined between the tubular member and the oscillatory rotating body. The hydraulic motor has a feeding channel through which the hydraulic fluid is fed into the working chambers and a discharging channel through which the hydraulic fluid is discharged from the working chambers.

The hydraulic motor is divided into a first block and a second block that are physically separate from each other. The first block includes the above-described tubular member. One of the first and second blocks is a stationary block fixedly attached to the device body, and the other is an output rotatable block rotatable when acted upon by the pressure of the hydraulic fluid.

The oscillatory rotating body is coupled with the second block via a rotation restricting shaft. The oscillatory rotating body has a spline hole. One of the ends of the rotation restricting shaft is engaged with the spline hole such that the rotation restricting shaft can yaw. The other end of the rotation restricting shaft is also engaged with a spline hole in the second block such that the rotation restricting shaft can yaw. The rotation restricting shaft couples the oscillatory rotating body to the second block such that the oscillatory rotating body is prevented from rotating relative to the second block, while allowing the oscillatory rotating body to eccentrically rotate (oscillatorily rotate). The hydraulic motor further has a channel changing unit. The channel changing unit changes the position where the feeding and discharging channels establish communication with the chambers, in the direction of the oscillatory rotation of the oscillatory rotating body.

As the channel changing unit is configured to change the position where the feeding and discharging channels establish communication with the chambers sequentially in the circumferential direction, the pressure of the hydraulic fluid produces a rotational force, which acts upon the oscillatory rotating body. While the external teeth of the oscillatory rotating body engage with the internal teeth of the first block, sliding occurs. As a result, the first or second block rotates at a speed reduced by a predetermined reduction ratio from the oscillatory rotation of the oscillatory rotating body.

When the above-described hydraulic motor is used in a traveling drive unit of a construction machine, it is desired to restrict unexpected rotation of the output rotatable block while the hydraulic motor is not in operation. The demand can be satisfied by a hydraulic motor including a brake mechanism (lock mechanism) (see, For example, Japanese Patent Application Publication No. 2011-220341 ("the '341 Publication")).

The hydraulic motor disclosed in the '341 Publication includes a lock pin and a lock hole. The lock hole is defined in the end surface of the oscillatory rotating body in the axial direction. The lock hole is centered on the same axis as the spline hole. The lock pin is provided on an end wall of a motor case that faces the end surface of the oscillatory rotating body in the axial direction. The lock pin is configured to be inserted into the lock hole. The lock pin is positioned to face the path described by the lock hole when the oscillatory rotating body oscillate (pivot). The lock pin is biased by a spring serving as a bias member toward the oscillatory rotating body. The rotation restricting shaft is inserted into the spline hole in the oscillatory rotating body. The rotation restricting shaft has a lock release rod that is configured to move forward or backward in response to the hydraulic pressure. While the lock pin is fitted in the lock hole, the lock release rod may be moved to press the end of the lock pin. In this manner, the lock pin can be disengaged from the lock hole. Once the hydraulic motor stops operating, the bias force of the spring member acts on the lock pin, which is positioned to face the path described by the oscillation of the lock hole, so that the lock pin is received in the lock hole. This prevents the oscillatory rotation of the oscillatory rotating body in the hydraulic motor.

In the hydraulic motor disclosed in the '341 Publication, the oscillatory rotation of the oscillatory rotating body may be prevented by the lock pin fitting into the lock hole once the lock hole in the oscillatory rotating body has moved to a position where the lock hole faces the lock pin. The hydraulic motor disclosed in the '341 Publication may thus face difficulties in controlling the lock hole to reliably receive the lock pin depending on how the hydraulic motor is suspended from operating. In addition, when the lock pin establishes the lock and the lock is released, enormous load may be disadvantageously applied to the lock pin and the periphery of the lock hole.

In the hydraulic motor disclosed in the '341 Publication, the lock pin constituting the brake mechanism (lock mechanism) is contained within a small space formed between the end surface of the oscillatory rotating body in the axial direction and the end wall of the motor case. A certain volume is required to allow the brake mechanism (lock pin and the like) to produce an effective brake force. As the lock pin is arranged within a limited space, however, a satisfactory volume may be hardly provided. An increase in volume of the brake mechanism (lock pin and the like) may lead to an increase in the overall size of the hydraulic motor.

In addition to the above-described hydraulic motor disclosed in the '341 Publication, a hydraulic pump is also known that has a plurality of working chambers and that is configured to gradually reduce the volumes of the working chambers. The hydraulic pump is divided into first and second blocks, one of which serves as a power input unit. The power input unit receives rotational power input thereto. The rotational power input into the power input unit gradually reduces the volumes of the working chambers formed between the internal and external teeth. The hydraulic pump can employ the same brake mechanism as the hydraulic motor disclosed in the '341 Publication to restrict the oscillatory rotating body from unexpectedly rotating while the hydraulic pump is not in operation. The hydraulic pump, however, faces the same problems as the hydraulic motor disclosed in the '341 Publication.

SUMMARY

The present invention is designed to provide a hydraulic device, a hydraulic motor and a construction machine that are capable of smoothly and reliably lock and unlock an oscillatory rotating body.

An aspect of the present invention provides a hydraulic device including: a first block having a block inner circumferential portion and a plurality of internal teeth on the block inner circumferential portion; a second block configured to rotate relative to the first block; an oscillatory rotating body having a plurality of external teeth, the external teeth being smaller in number than the internal teeth, the oscillatory rotating body being provided inside the first block such that the oscillatory rotating body is oscillatorily rotatable, the oscillatory rotating body having an inner circumferential portion, the internal teeth and the external teeth defining a working chamber therebetween; a rotation restricting shaft extending from the inner circumferential portion of the oscillatory rotating body in a direction intersecting a radial direction, the rotation restricting shaft coupling the oscillatory rotating body and the second block such that the oscillatory rotating body and the second block are not allowed to rotate relative to each other while allowing the oscillatory rotating body to oscillatorily rotate; a first friction plate configured to rotate together with the oscillatory rotating body; a second friction plate restricted from rotating by the second or first block; and a press mechanism configured to press the first and second friction plates against each other.

In the above-described implementation, the oscillatory rotation of the oscillatory rotating body is not restricted while the press mechanism is not pressing the first and second friction plates against each other. If the hydraulic device is a hydraulic motor, the oscillatory rotating body can oscillatorily rotate due to the pressure produced by the hydraulic fluid sequentially fed to and discharged from the respective working chambers. The oscillatory rotation is reduced by a predetermined reduction ratio and then output to outside through the first or second block. If the hydraulic device is a hydraulic pump, the first or second block is driven and thus rotated, the volumes of the working chambers sequentially increase and decrease, and the hydraulic fluid is introduced through the inlet channel and pumped out through the outlet channel. On the other hand, while the hydraulic device is suspended from operating, the first and second plates are pressed against each other by the press mechanism. This locks the rotation of the first friction plate, which is linked to the oscillatory rotating body. As a result, the oscillatory rotation of the oscillatory rotating body is also locked. In the above-described hydraulic device, the oscillatory rotation of the oscillatory rotating body is locked by the frictional contact between the first and second friction plates. The first and second friction plates may start pressing each other before the hydraulic device is completely suspended from operating. In this case, the oscillatory rotation of the oscillatory rotating body can be still smoothly and reliably locked irrespective of the rotational phase of the oscillatory rotating body.

The first and second friction plates may be shaped annularly, and the first and second friction plates may be disposed in a region surrounding the rotation restricting shaft.

In the implementation, since the annular first and second friction plates are disposed in the region surrounding the rotation restricting shaft, a large braking torque can be efficiently produced in the region surrounding the rotation restricting shaft.

The hydraulic device may include a rotation converting block configured to extract an oscillation component of the oscillatory rotating body as synchronous rotation about an axis of rotation of the first block, and the first friction plate may be supported by the rotation converting block such that the first friction plate is not allowed to rotate relative to the rotation converting block.

In the implementation, the rotation converting block can extract only the rotation component from the oscillatory behavior of the oscillatory rotating body, and the braking force created by the first and second friction plates is applied to the rotation converting block. In this case, the required braking torque can be reduced when compared with the case where the braking torque is directly applied to the oscillatorily rotating oscillatory rotating body. In the implementation, the brake mechanism can be reduced in size.

The oscillatory rotating body may have an end surface, and the first friction plate may be attached to the end surface such that the first friction plate is not allowed to rotate relative to the oscillatory rotating body.

In the implementation, the braking torque can be directly applied to the oscillatorily rotating oscillatory rotating body. The implementation can achieve a reduced number of parts when compared with the case where the rotation converting block is employed. Accordingly, the present implementation can achieve a reduced cost.

The first friction plate may be attached to an outer periphery of the rotation restricting shaft such that the first friction plate is not allowed to rotate relative to the rotation restricting shaft.

In the implementation, the braking torque can be applied to the rotation restricting shaft configured to oscillatorily rotate synchronously with the oscillatory rotating body. Accordingly, the oscillatory rotating body can be braked with a smaller number of parts and in a simplified manner. The implementation can achieve a reduced cost.

The press mechanism may include: a press member configured to apply a pressing force to the first and second friction plates; a bias device configured to bias the press member in such a direction that the first and second friction plates frictionally touch each other; and a brake release device configured to move the press member in such a direction that frictional contact between the first and second friction plates is removed.

In the implementation, the brake release device may be turned off to brake the movement of the oscillatory rotating body. Accordingly, the press member is biased by the bias device to press the first and second friction plates against each other. This results in braking the movement of the oscillatory rotating body and the first friction plate. In the implementation, the brake release device may be turned on to release the braking applied to the oscillatory rotating body. The press member accordingly moves in such a direction that the frictional contact between the first and second friction plates may be removed. As a result, the braking torque no longer acts on the first friction plate and oscillatory rotating body.

The brake release device may be constituted by a piston device configured to move the press member in a friction removing direction using pressure produced by an introduced hydraulic fluid.

In the implementation, while the hydraulic device is in operation, the hydraulic fluid applies pressure to the piston device. This results in moving the press member in the friction removing direction. Accordingly, the braking torque is no longer generated between the first and second friction plates, so that the oscillatory rotating body is allowed to freely oscillatorily rotate. While the hydraulic device is suspended from operating, the hydraulic fluid does not apply pressure to the piston device. The press member is thus subject to the bias force of the bias device, to cause the first and second friction plates to frictionally touch each other. This results in braking the oscillatory rotating body. While the hydraulic device of the implementation is in operation, the hydraulic fluid applies pressure to automatically suspend the brake mechanism from operating. While the hydraulic device is suspended from operating, the pressure applied by the hydraulic fluid drops, so that the first and second friction plates are automatically pressed against each other. In the implementation, it is not required to manually operate the brake mechanism.

As well as the first and second friction plates, the press member, the bias device and the piston device may be disposed in a region surrounding the rotation restricting shaft.

This means that the main constituents of the brake mechanism are arranged in the region surrounding the rotation restricting shaft and thus overlap the rotation restricting shaft in the axial direction. Accordingly, the hydraulic device relating to the implementation can have a reduced overall size in the axial direction.

Another aspect of the present invention provides a hydraulic device including: a first block having a block inner circumferential portion and a plurality of internal teeth on the block inner circumferential portion; a second block configured to rotate relative to the first block; an oscillatory rotating body having a plurality of external teeth, the external teeth being smaller in number than the internal teeth, the oscillatory rotating body being provided inside the first block such that the oscillatory rotating body is oscillatorily rotatable, the oscillatory rotating body having an inner circumferential portion, the internal teeth and the external teeth defining a working chamber therebetween; a rotation restricting shaft extending from the inner circumferential portion of the oscillatory rotating body in a direction intersecting a radial direction, the rotation restricting shaft coupling the oscillatory rotating body and the second block such that the oscillatory rotating body and the second block are not allowed to rotate relative to each other while allowing the oscillatory rotating body to oscillatorily rotate; a brake mechanism configured to lock oscillatory rotation of the oscillatory rotating body. At least part of the brake mechanism is disposed in a region surrounding the rotation restricting shaft.

In the implementation, the rotation of the oscillatory rotating body is not restricted while the brake mechanism is not applying a brake. If the hydraulic device is a hydraulic motor, the oscillatory rotating body oscillatorily rotates due to the pressure produced by the hydraulic fluid sequentially fed to and discharged from the working chambers. The oscillatory rotation is reduced by a predetermined reduction ratio and then output to outside through the first or second block. If the hydraulic device is a hydraulic pump, the first or second block is driven and thus rotated, the volumes of the working chambers sequentially increase and decrease, and the hydraulic fluid is introduced through the inlet channel and pumped out through the outlet channel. While the hydraulic device is suspended from operating, the brake mechanism applies a brake and the oscillatory rotation of the oscillatory rotating body is locked. In the hydraulic device of the above-described implementation, at least some of the constituents of the brake mechanism are disposed in the region surrounding the rotation restricting shaft. In other words, the constituents of the brake mechanism are disposed in a sufficiently spacious region, to be specific, in the region surrounding the rotation restricting shaft. According to the implementation, while an increase in the overall size of the hydraulic device is prevented, the brake mechanism can have an increased volume.

The brake mechanism may include a first friction plate configured to rotate together with the oscillatory rotating body, a second friction plate restricted from rotating by the second or first block, and a press mechanism configured to press the first and second friction plates against each other.

In the above-described hydraulic device, the oscillatory rotation of the oscillatory rotating body is braked by the frictional contact between the first and second friction plates. The first and second friction plates may start pressing each other before the hydraulic device is completely suspended from operating. The oscillatory rotation of the oscillatory rotating body can be still smoothly and reliably locked irrespective of the rotational phase of the oscillatory rotating body.

An aspect of the present invention provides a hydraulic motor including: a first block having a block inner circumferential portion and a plurality of internal teeth on the block inner circumferential portion; a second block configured to rotate relative to the first block; an oscillatory rotating body having a plurality of external teeth, the external teeth being smaller in number than the internal teeth, the oscillatory rotating body being provided inside the first block such that the oscillatory rotating body is oscillatorily rotatable, the oscillatory rotating body having an inner circumferential portion, the internal teeth and the external teeth defining a working chamber therebetween; a rotation restricting shaft extending from the inner circumferential portion of the oscillatory rotating body in a direction intersecting a radial direction, the rotation restricting shaft coupling the oscillatory rotating body and the second block such that the oscillatory rotating body and the second block are not allowed to rotate relative to each other while allowing the oscillatory rotating body to oscillatorily rotate; a feeding channel through which a hydraulic fluid is fed to the working chamber; a discharging channel through which the hydraulic fluid is discharged from the working chamber; a channel changing unit configured to change, in a direction of oscillatory rotation of the oscillatory rotating body, a position where the feeding and discharging channels communicate with the working chamber; a first friction plate configured to rotate together with the oscillatory rotating body; a second friction plate restricted from rotating by the second or first block; and a press mechanism configured to press the first and second friction plates against each other.

Another aspect of the present invention provides a hydraulic motor including: a first block having a block inner circumferential portion and a plurality of internal teeth on the block inner circumferential portion; a second block configured to rotate relative to the first block; an oscillatory rotating body having a plurality of external teeth, the external teeth being smaller in number than the internal teeth, the oscillatory rotating body being provided inside the first block such that the oscillatory rotating body is oscillatorily rotatable, the oscillatory rotating body having an inner circumferential portion, the internal teeth and the external teeth defining a working chamber therebetween; a rotation restricting shaft extending from the inner circumferential portion of the oscillatory rotating body in a direction intersecting a radial direction, the rotation restricting shaft coupling the oscillatory rotating body and the second block such that the oscillatory rotating body and the second block are not allowed to rotate relative to each other while allowing the oscillatory rotating body to oscillatorily rotate; a feeding channel through which a hydraulic fluid is fed to the working chamber; a discharging channel through which the hydraulic fluid is discharged from the working chamber; a channel changing unit configured to change, in a direction of oscillatory rotation of the oscillatory rotating body, a position where the feeding and discharging channels communicate with the working chamber; and a brake mechanism configured to lock oscillatory rotation of the oscillatory rotating body. At least part of the brake mechanism is disposed in a region surrounding the rotation restricting shaft.

An aspect of the present invention provides a construction machine including: a traveling drive unit; and a hydraulic motor configured to drive the traveling drive unit using a pressure produced by a hydraulic fluid. The hydraulic motor includes: a first block having a block inner circumferential portion and a plurality of internal teeth on the block inner circumferential portion; a second block configured to rotate relative to the first block; an oscillatory rotating body having a plurality of external teeth, the external teeth being smaller in number than the internal teeth, the oscillatory rotating body being provided inside the first block such that the oscillatory rotating body is oscillatorily rotatable, the oscillatory rotating body having an inner circumferential portion, the internal teeth and the external teeth defining a working chamber therebetween; a rotation restricting shaft extending from the inner circumferential portion of the oscillatory rotating body in a direction intersecting a radial direction, the rotation restricting shaft coupling the oscillatory rotating body and the second block such that the oscillatory rotating body and the second block are not allowed to rotate relative to each other while allowing the oscillatory rotating body to oscillatorily rotate; a feeding channel through which the hydraulic fluid is fed to the working chamber; a discharging channel through which the hydraulic fluid is discharged from the working chamber; a channel changing unit configured to change, in a direction of oscillatory rotation of the oscillatory rotating body, a position where the feeding and discharging channels communicate with the working chamber; a first friction plate configured to rotate together with the oscillatory rotating body; a second friction plate restricted from rotating by the second or first block; and a press mechanism configured to press the first and second friction plates against each other.

Another aspect of the present invention provides a construction machine including: a traveling drive unit; and a hydraulic motor configured to drive the traveling drive unit using a pressure produced by a hydraulic fluid. The hydraulic motor includes: a first block having a block inner circumferential portion and a plurality of internal teeth on the block inner circumferential portion; a second block configured to rotate relative to the first block; an oscillatory rotating body having a plurality of external teeth, the external teeth being smaller in number than the internal teeth, the oscillatory rotating body being provided inside the first block such that the oscillatory rotating body is oscillatorily rotatable, the oscillatory rotating body having an inner circumferential portion, the internal teeth and the external teeth defining a working chamber therebetween; a rotation restricting shaft extending from the inner circumferential portion of the oscillatory rotating body in a direction intersecting a radial direction, the rotation restricting shaft coupling the oscillatory rotating body and the second block such that the oscillatory rotating body and the second block are not allowed to rotate relative to each other while allowing the oscillatory rotating body to oscillatorily rotate; a feeding channel through which the hydraulic fluid is fed to the working chamber; a discharging channel through which the hydraulic fluid is discharged from the working chamber; a channel changing unit configured to change, in a direction of oscillatory rotation of the oscillatory rotating body, a position where the feeding and discharging channels communicate with the working chamber; a brake mechanism configured to lock oscillatory rotation of the oscillatory rotating body. At least part of the brake mechanism is disposed in a region surrounding the rotation restricting shaft.

Advantageous Effects

The hydraulic device relating to the above-described aspect of the present invention includes a first friction plate configured to rotate together with an oscillatory rotating body, a second friction plate restricted from rotating by the second or first block, and a press mechanism configured to press the first and second friction plates against each other. As the press mechanism presses the first and second friction plates against each other, this locks the oscillatory rotation of the oscillatory rotating body. Accordingly, the hydraulic motor relating to the aspect can smoothly and reliably lock the oscillatory rotating body and release the lock.

In the hydraulic motor relating to the other above-described aspect, at least some of the constituents of the brake mechanism are disposed in the region surrounding the rotation restricting shaft. In other words, the constituents of the brake mechanism are disposed in a sufficiently spacious region, to be specific, in the region externally surrounding the rotation restricting shaft. While an increase in the overall size of the hydraulic device is prevented, the brake mechanism can have an increased volume. Accordingly, the hydraulic motor relating to the other aspect can smoothly and reliably lock the oscillatory rotating body and release the lock.

DESCRIPTION OF THE PREFERRED EMBODIMENTS

The embodiments of the present invention will be hereinafter described with reference to the drawings. In the following embodiments and modification examples, like elements will be denoted by the same reference signs and redundant descriptions will be partly omitted.

<Construction Machine>

Figure 1:
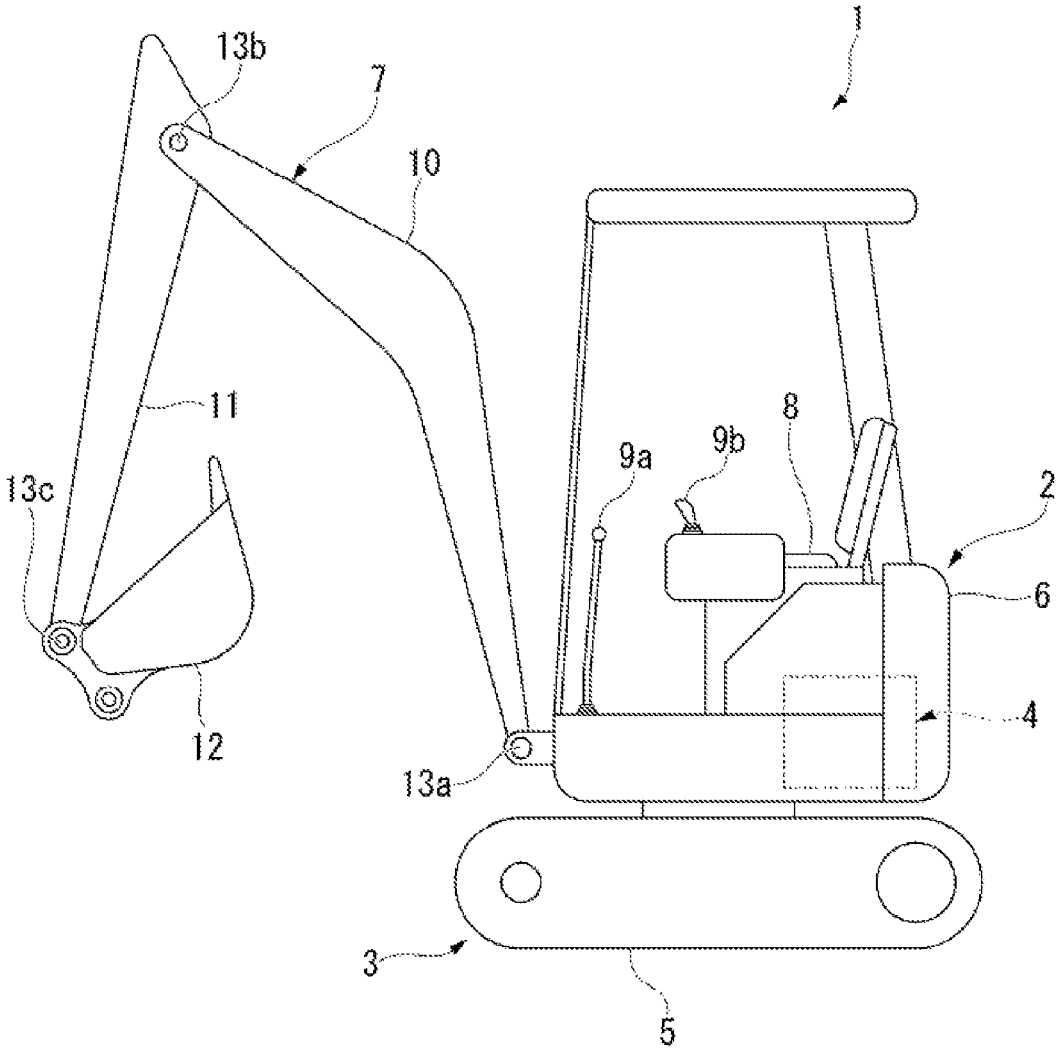
FIG. 1 is a side view showing a construction machine relating to an embodiment.

FIG. 1 schematically illustrates the configuration of an excavator 1, which is an embodiment of a construction machine, viewed from the side. The excavator 1 includes a slewable upper structure 2 and an undercarriage 3. The slewable upper structure 2 is provided on the undercarriage 3 and capable of slewing. In the slewable upper structure 2, a hydraulic drive system 4 is mounted to hydraulically drive the parts of the slewable upper structure 2 and a traveling drive unit. The undercarriage 3 includes, for example, a crawler 5 (traveling drive unit). The crawler 5 is in contact with the ground. The crawler 5 can be driven by any one of the hydraulic motors (hydraulic devices) relating to the following embodiments. As the crawler 5 is driven, the excavator 1 can travel on the ground. The traveling drive unit of the undercarriage 3 may not be limited to the crawler 5 but may be wheels or the like.

The upper slewable structure 2 includes a cab 6 where an operator can be accommodated and an articulate movable part 7 to be manipulated by the operator. On the cab 6, a seat 8 and a plurality of controlling units 9*a* and 9*b* are provided. The operator can be seated on the seat 8. The controlling units 9*a* and 9*b* are levers and switches to be manipulated by the operator seated on the seat 8.

The articulate movable part 7 includes a boom 10, an arm 11, and a bucket 12. The base end of the boom 10 is coupled with the front end of the cab 6 such that the boom 10 can swing about an axis of rotation 13*a*. The base end of the arm 11 is coupled with the tip end of the boom 10 such that the arm 11 can swing about an axis of rotation 13*b*. The base end of the bucket 12 is coupled with the tip end of the arm 11 such that the bucket 12 can swing about an axis of rotation 13*c*. The coupling parts between the boom 10, arm 11 and bucket 12 of the articulate movable part 7 are manipulated in a coordinated manner, so that the bucket 12 can scoop soil, rubble or the like. The coupling parts of the articulate movable part 7 can be driven by a hydraulic motor, which is not shown. Any of the hydraulic motors described below can be employed in the coupling parts.

First Embodiment

Figure 2:
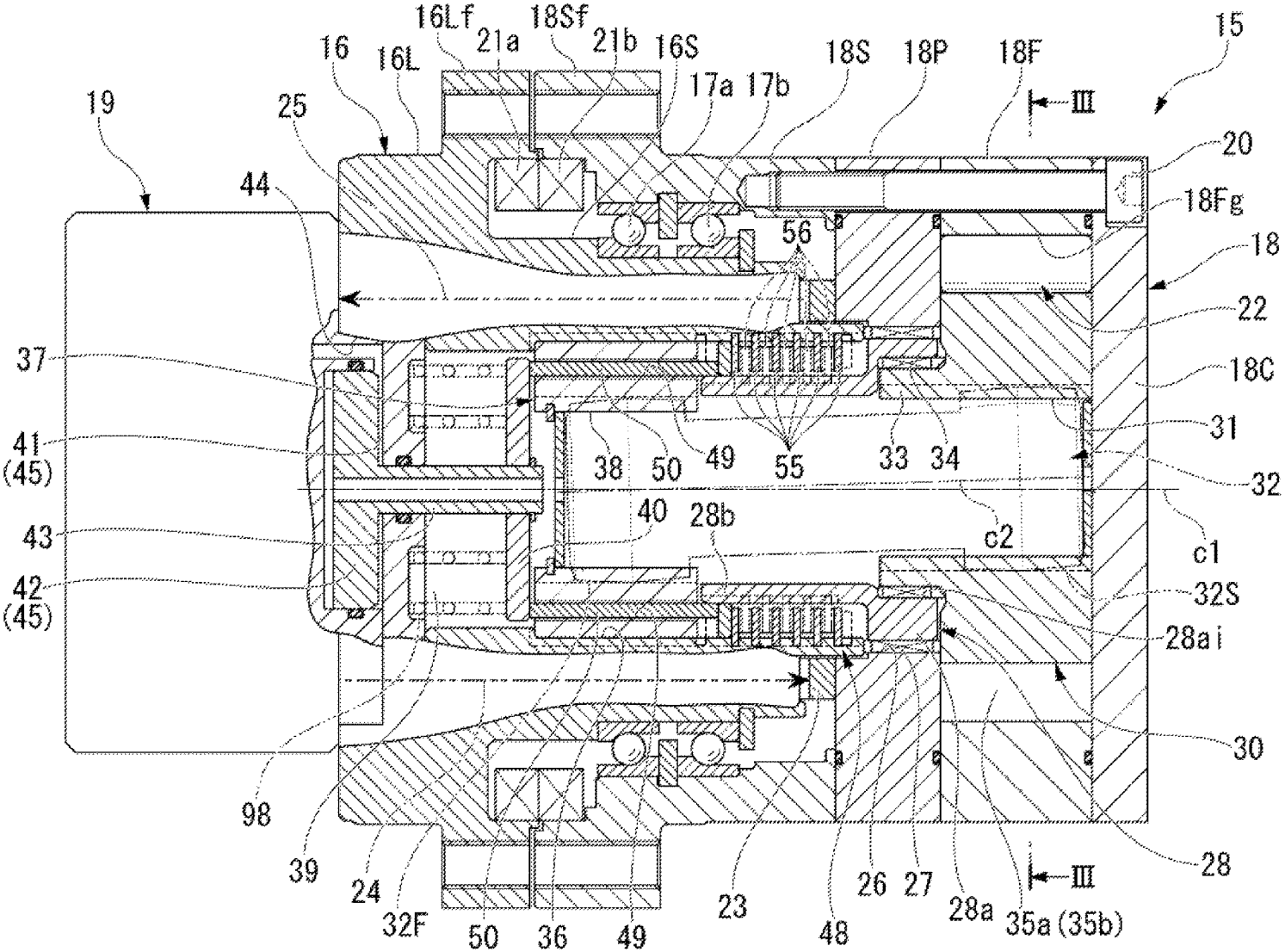
FIG. 2 is a vertical sectional view showing a hydraulic motor (hydraulic device) according to a first embodiment.
Figure 3:
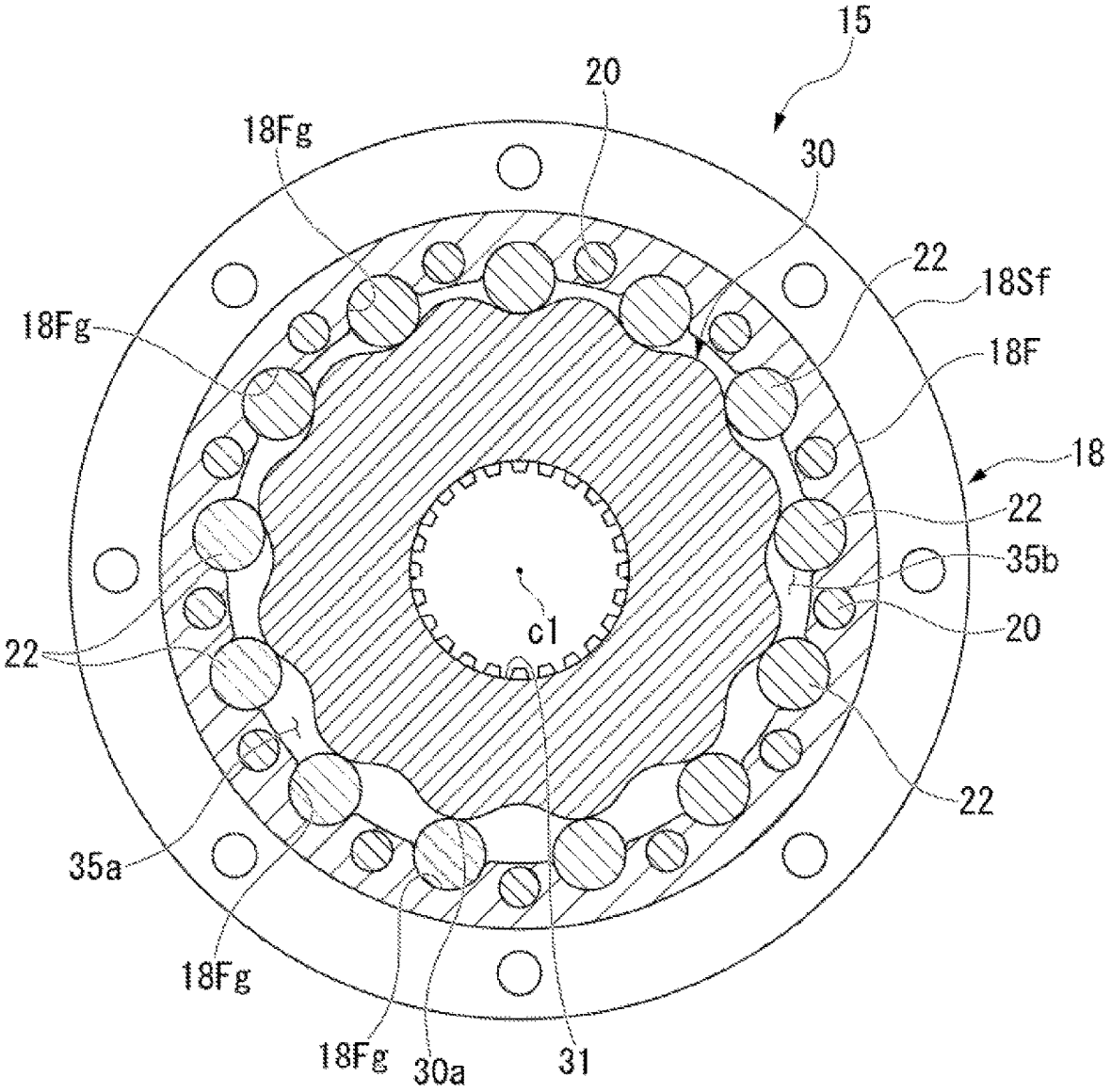
FIG. 3 is a sectional view along the line III-III in FIG. 2.

FIG. 2 is a vertical sectional view showing a hydraulic motor 15 (hydraulic device) according to a first embodiment. FIG. 3 is a sectional view along the line III-III in FIG. 2. The hydraulic motor 15 includes a stationary block 16 and an output rotatable block 18. The stationary block 16 is substantially shaped like a circular column and fixedly attached to the main body of the construction machine. The output rotatable block 18 is rotatably supported by the stationary block 16 via bearings 17*a* and 17*b*. The output rotatable block 18 is substantially shaped like a circular tube. The output rotatable block 18 is coupled with the traveling drive unit, which is, for example, the crawler 5 of the construction machine (see FIG. 1). In the present embodiment, the output rotatable block 18 constitutes a first block, and the stationary block 16 constitutes a second block.

The stationary block 16 and output rotatable block 18 are arranged such that the central axis of the stationary block 16 coincides with the axis of rotation of the output rotatable block 18. In the following description, the central axis and the axis of rotation are collectively referred to as a first axis c1. The term "axial direction" may refer to a direction parallel to the first axis c1, the term "circumferential direction" may refer to the direction of the rotation of the output rotatable block 18, and the term "radial direction" may refer to the radial direction of the output rotatable block.

The stationary block 16 includes a large diameter portion 16L and a small diameter portion 16S. The large diameter portion 16L faces a first direction (located on the left side in FIG. 2) in the axial direction. The small diameter portion 16S faces a second direction opposite to the first direction (located on the right side in FIG. 2) in the axial direction. The outer diameter of the small diameter portion 16S is less than that of the large diameter portion 16L. The large diameter portion 16L and small diameter portion 16S are coaxially arranged and form a single piece. The small diameter portion 16S is received in the tubular portion of the output rotatable block 18 that faces the first direction. The small diameter portion 16S thus rotatably supports the output rotatable block 18 via the bearings 17*a* and 17*b*.

The stationary block 16 has an outer flange 16Lf projecting outward in the radial direction. The outer flange 16Lf forms a part of the large diameter portion 16L. The outer flange 16Lf is fixedly secured using bolts or the like onto the main body of the construction machine, so that the hydraulic motor 15 can be attached to the construction machine. A channel block 19 is attached to the end of the stationary block 16 facing the first direction. The channel block 19 has a feeding channel and a discharging channel accommodated therein. A hydraulic fluid is fed through the feeding channel and discharged through the discharging channel. The channels accommodated within the channel block 19 are connected to a reservoir tank and a pump device, which are not shown. The reservoir tank is configured to store the hydraulic fluid, and the pump device is configured to pump out the hydraulic fluid.

The output rotatable block 18 includes a first tubular portion 18F, a second tubular portion 18S, a feeding and discharging plate 18P, an end cover 18C. The first tubular portion 18F is arranged at the end facing the second direction. The first tubular portion 18F is substantially shaped like a circular tube. The second tubular portion 18S is arranged at the end facing the first direction. The feeding and discharging plate 18P is sandwiched between the first and second tubular portions 18F and 18S. The feeding and discharging plate 18P is shaped like a perforated disc. The end cover 18C closes the opening of the first tubular portion 18F from the second direction side. The end cover 18C, first tubular portion 18F, feeding and discharging plate 18P and second tubular portion 18S are combined together using a fastening bolt 20 extending in the axial direction.

The output rotatable block 18 has an outer flange 18Sf projecting outward in the radial direction. The outer flange 18Sf constitutes part of the end of the second tubular portion 18S facing the first direction. The outer flange 18Sf is coupled and fastened using bolts and the like with the traveling drive unit of the construction machine (for example, the crawler 5 shown in FIG. 1). The bearings 17*a* and 17*b*, which rotatably support the output rotatable block 18, are arranged between the small diameter portion 16S of the stationary block 16 and the inner surface of the second tubular portion 18S. Here, the reference numerals 21*a* and 21*b* in FIG. 2 indicate mechanical seals. The mechanical seals 21*a* and 21*b* seal the abutting portions between the large diameter portion 16L of the stationary block 16 and the second tubular portion 18S of the output rotatable block 18.

In the embodiment, the first tubular portion 18F constitutes the tubular portion of the first block. In other words, the first tubular portion 18F constitutes a block inner circumferential portion of the first block. The inner circumferential surface of the first tubular portion 18F has a plurality of pin grooves 18Fg arranged at equal intervals in the circumferential direction. The pin grooves 18Fg extend in the axial direction. The pin grooves 18Fg have a semicircular shape when seen in the axial direction. Each pin groove 18Fg receives an internal tooth pin 22 therein. The internal tooth pins 22 are shaped like a circular column and housed in a rotatable manner. Since the pin grooves 18Fg have a semicircular shape, the internal tooth pins 22 radially inwardly protrude beyond the inner circumferential surface of the first tubular portion 18F and the protruding portions of the internal tooth pins 22 are also shaped like a semicircle. The internal tooth pins 22 serve as internal teeth meshing with external teeth 30*a* of an oscillatory rotating body 30, which will be described below.

The oscillatory rotating body 30 has a diameter smaller than the maximum inner diameter of the first tubular portion 18F. When the internal tooth pins 22 touch and mesh with the external teeth 30*a* of the oscillatory rotating body 30, a plurality of working chambers 35*a* and 35*b* are formed between the first tubular portion 18F and the oscillatory rotating body 30 and arranged next to each other in the circumferential direction. The working chambers 35*a* and 35*b* are closed by the feeding and discharging plate 18 at the first direction side. The working chambers 35*a* and 35*b* are closed by the end cover 18C at the second direction side. Although not shown, the feeding and discharging plate 18P has a plurality of through holes through which the hydraulic fluid is supplied into and discharged from the working chambers 35*a* and 35*b*.

The feeding and discharging plate 18P has an annular shape when viewed in the axial direction. The inner edge portion of the feeding and discharging plate 18P is positioned radially inside the inner circumferential surface of the first and second tubular portions 18F and 18S. Although not shown, the above-mentioned through holes extend through the inner edge portion of the feeding and discharging plate 18P in the thickness direction. The through holes are open toward the concave spaces facing inward and formed between adjacent ones of the internal tooth pins 22 arranged on the inner circumferential surface of the first tubular portion 18F.

An annular slidable plate 23 abuts against the inner edge portion of the first-direction-side end surface of the feeding and discharging plate 18P. The slidable plate 23 is supported on the second-direction-side end surface of the small diameter portion 16S of the stationary block 16 while being not allowed to rotate. The slidable plate 23 is pressed by a bias member, which is not shown, against the end surface of the feeding and discharging plate 18P and allowed to move in the axial direction.

Although not shown, the slidable plate 23 has feeding communication holes in communication with the feeding channel 24 and discharging communication holes in communication with the discharging channel 25. The feeding and discharging communication holes are arranged to draw a ring. The communication holes are positioned on the circle having the same radius as the circle described by the through holes in the feeding and discharging plate 18P. The number of the communication holes is smaller by one than the number of the through holes in the feeding and discharging plate 18P. As the feeding and discharging plate 18P rotates on the first axis c1 integrally with the first tubular portion 18F, the slidable plate 23 works coordinately with the feeding and discharging plate 18P to change the position where the feeding and discharging channels 24 and 25 communicate with the working chambers 35*a* and 35*b*, in the direction of the oscillatory rotation of the oscillatory rotating body 30. In the present embodiment, the slidable plate 23 and feeding and discharging plate 18P constitute the channel changing unit. The feeding channel 24 is connected to the source portion of the hydraulic fluid of the circuit housed within the channel block 19. The feeding channel 24 is formed in the stationary block 16. The discharging channel 25 is connected to the collector portion of the hydraulic fluid of the circuit housed within the channel block 19. The discharging channel 25 is formed in the stationary block 16, like the feeding channel 24.

Inside the first tubular portion 18F of the output rotatable block 18, the oscillatory rotating body 30 is disposed such that it can oscillatorily rotate. The oscillatory rotating body 30 is configured to oscillatorily rotate on the first axis c1 at a predetermined pivot radius. The outer circumferential surface of the oscillatory rotating body 30 faces in the radial direction the internal tooth pins 22 of the first tubular portion 18F. The external teeth 30*a* of the oscillatory rotating body 30 mesh with the internal tooth pins 22 of the first tubular portion 18F. The number of the external teeth 30*a* of the oscillatory rotating body 30 is slightly less than the number of the internal tooth pins 22 of the first tubular portion 18F. For example, the number of the external teeth 30*a* is smaller by one than the number of the internal tooth pins 22.

While the oscillatory rotating body 30 is oscillatorily rotating, the external teeth 30*a* constantly remain in contact with the internal teeth of the first tubular portion 18F (internal tooth pins 22) at a portion between the tooth tip and the tooth root. In this manner, the two working chambers 35*a* and 35*b* are roughly defined between the inner circumferential surface of the first tubular portion 18F and the external teeth 30*a* of the oscillatory rotating body 30. In the region surrounding the oscillatory rotating body 30, the two working chambers 35*a* and 35*b* are line symmetrical to each other when seen in the axial direction.

The working chambers 35*a* and 35*b* are in communication with the feeding and discharging channels 24 and 25 via the through holes in the feeding and discharging plate 18P. As the slidable plate 23 and feeding and discharging plate 18P cooperate to perform the channel changing function as described above, the hydraulic fluid is fed to and discharged from the working chambers 35*a* and 35*b* such that the oscillatory rotating body 30 can oscillatorily rotate. The two working chambers 35*a* and 35*b* move in the circumferential direction in the direction of the oscillatory rotation of the oscillatory rotating body 30.

The feeding and discharging plate 18P has a circular guide hole 26 extending through the feeding and discharging plate 18P in the axial direction. The guide hole 26 is formed in the radially inner portion of the feeding and discharging plate 18P. In the guide hole 26, a rotation converting block 28 is rotatably supported via a bearing 27, which is a needle bearing or the like.

The rotation converting block 28 is a substantially tubular member shaped like a stepped circular cylinder. The rotation converting block 28 includes a large diameter tubular portion 28*a* and a small diameter tubular portion 28*b*. The large diameter tubular portion 28*a* faces the second direction. The small diameter tubular portion 28*b* is integrated with the large diameter tubular portion 28*a* and positioned on the first direction side of the large diameter tubular portion 28*a*. The outer circumferential surface of the large diameter tubular portion 28*a* is circular and centered on the same point as the outer and inner circumferential surfaces of the small diameter tubular portion 28*b*. On the other hand, the inner circumferential surface 28*ai* of the large diameter tubular portion 28*a* is circular, but centered on a point shifted from the center of the circular outer circumferential surface (first axis c1). In other words, the inner circumferential surface 28*ai* of the large diameter tubular portion 28*a* is centered on a different point than the guide hole 26 of the feeding and discharging plate 18P.

The oscillatory rotating body 30 has a spline hole 31 of a predetermined inner diameter at the center thereof. The spline hole 31 has a plurality of splines on the inner surface so as to extend in the axial direction. The spline hole 31 receives therein the end of a rotation restricting shaft 32 that faces the second direction. The rotation restricting shaft 32 will be described below. In FIG. 2, the rotation restricting shaft 32 is represented by the dotted line for the sake of convenience. The oscillatory rotating body 30 has a boss 33 shaped like a circular tube and protruding toward the first direction from the inner circumferential edge of the oscillatory rotating body 30 that faces the first direction. The boss 33 is seamlessly formed on the oscillatory rotating body 30. The boss 33 is received in the inner circumferential surface 28*ai* of the large diameter tubular portion 28*a* of the rotation converting block 28. The boss 33 is rotatably supported by the inner circumferential surface 28*ai* of the large diameter tubular portion 28*a* via a bearing 34, which is a needle bearing or the like. The amount of eccentricity of the inner circumferential surface 28*ai* of the large diameter tubular portion 28*a* from the first axis c1 is equal to the radius of the pivot of the oscillatory rotating body 30 about the first axis c1. In this manner, while being allowed to oscillatorily rotate, the oscillatory rotating body 30 is supported by the feeding and discharging plate 18P via the rotation converting block 28 and bearings 34 and 27. The rotation of the rotation converting block 28 caused by the pivot (oscillatory rotation) of the oscillatory rotating body 30 is the result of extracting the oscillation component of the oscillatory rotating body 30 as the synchronous rotation about the first axis c1. The rotation converting block 28 can extract the oscillation component of the oscillatory rotating body 30 as the synchronous rotation about the first axis c1.

The stationary block 16 has a device housing hole 36 in the radially central region. The device housing hole 36 extends through the stationary block 16 in the axial direction. In the device housing hole 36, a spline block 37 substantially shaped like a circular tube is provided at the substantially middle portion in the axial direction. The spline block 37 is seamlessly coupled with the stationary block 16. The spline block 37 has a spline bole 38. The axis of the spline hole 38 coincides with the first axis c1. A plurality of splines extend in the axial direction on the inner circumferential surface of the spline hole 38. The spline hole 38 receives therein the end of the rotation restricting shaft 32 that faces the first direction.

The rotation restraining shaft 32 is a shaft member extending from the inner circumferential portion of the oscillatory rotating body 30 in the direction intersecting the radial direction. The rotation restricting shaft 32 couples the oscillatory rotating body 30 to the stationary block 16 (second block) such that the oscillatory rotating body 30 is prevented from rotating relative to the stationary block 16 (second block), while allowing oscillatory rotation of the oscillatory rotating body 30. The rotation restricting shaft 32 has a first external spline 32F on the outer periphery of its end facing the first direction and also has a second external spline 32S on the outer periphery of its end facing the second direction. The first and second external splines 32F and 32S both have a greater outer diameter than the middle region of the rotational restricting shaft 32 in the axial direction. The first and second external splines 32F and 32S each have a spline tooth. In each spline tooth, the middle region in the axial direction is the most raised portion outwardly in the radial direction. This region is referred to as the maximally raised portion. Each spline tooth is substantially shaped like an arc. To be specific, the height of the tooth surface gently decreases from the maximally raised portion to the respective ends in the axial direction.

The first external spline 32F of the rotation restricting shaft 32 meshes with the spline hole 38 in the spline block 37. The second external spline 32S of the rotation restricting shaft 32 meshes with the spline hole 31 in the oscillatory rotating body 30. In this manner, the rotation of the oscillatory rotating body 30 (on its own axis) is restricted by the stationary block 16. The spline tooth of the first external spline 32F of the rotation restricting shaft 32 is inclined within the spline hole 38 in the radial direction. The spline tooth of the second external spline 32S is inclined within the spline hole 31 in the radial direction. This allows the oscillatory rotation (pivot) of the oscillatory rotating body 30 about the first axis c1. Here, the reference numeral c2 in FIG. 2 indicates the axis of the rotation restricting shaft 32. The axis c2 of the rotation restricting shaft 32 intersects with the first axis c1 about which the output rotatable block 18 can rotate at the position coinciding with substantially the center of the spline block 37. The axis c2 forms a predetermined angle relative to the first axis c1 at the intersection.

In the device housing hole 36, a plate housing chamber 39 is defined between the front surface of the channel block 19 and the spline block 37. The plate housing chamber 39 is positioned on the first direction side with respect to the spline block 37. In the plate housing chamber 39, a press plate 40 shaped like a disc is housed together with a bias spring 98 (bias device), which is configured to bias the press plate 40 toward the second direction.

In the channel block 19, a cylinder chamber 41 is defined. In the cylinder chamber 41, a piston device 45 is provided. The piston device 45 has a piston 42 slidably housed therein. The piston 42 is housed in the cylinder chamber 41 such that it is movable forward and backward in the axial direction. The piston 42 has a coupling rod 43 to couple the piston 42 to the press plate 40. The coupling rod 43 couples together the press plate 40 and piston 42. In this manner, the press plate 40 and piston 42 are integrally movable in the axial direction. As a result, the piston 42 is subject to the bias force applied by the bias spring 98 via the press plate 40 and coupling rod 43.

In the cylinder chamber 41, the piston 42 defines a space facing the second direction, which is connected to a pressure inlet channel 44. The piston 42 is pushed toward the first direction by the pressure produced by the hydraulic fluid flowing into the cylinder chamber 41 though the pressure inlet channel 44. The piston 42 is coupled with the press plate 40. The press plate 40 thus overcomes the bias force applied by the bias spring 98 and moves backward toward the first direction. In the present embodiment, the piston device 45 including the cylinder chamber 41 and piston 42 constitutes a brake release device when combined with the pressure inlet channel 44.

In the device housing hole 36, the small diameter tubular portion 28*b* of the rotation converting block 28 supported by the feeding and discharging plate 18P is disposed in the region facing the second direction with respect to the spline block 37. In the device housing hole 36, a plurality of stationary friction plates 55 shaped like a ring are provided in the region facing the outer circumferential surface of the small diameter tubular portion 28*b*. The stationary friction plates 55 are mounted on the inner periphery of the device housing hole 36 such that they are movable in the axial direction but not allowed to rotate relative to the inner periphery. Specifically, the inner circumferential surface of the device housing hole 36 have a plurality of slit grooves along the axial direction, for example, and the stationary friction plates 55 have a plurality of claws on their outer circumferential portion. The claws are inserted in the slit grooves. The last friction plate 55 on the second direction side is prevented from moving toward the second direction by a restricting member fixedly attached to the stationary block 16.

On the outer periphery of the small diameter tubular portion 28*b* of the rotation converting block 28, a plurality of rotatable friction plates 56 shaped like a ring are provided. In FIG. 2, the rotatable friction plates 56 are represented by the dotted line for the sake of convenience. The rotatable friction plates 56 are mounted on the outer periphery of the small diameter tubular portion 28*b* such that they are movable in the axial direction but not allowed to rotate relative to the outer periphery. Specifically, for example, the outer circumferential surface of the small diameter tubular portion 28*b* has a plurality of slit grooves along the axial direction, for example, and the rotatable friction plates 56 have a plurality of claws on their inner circumferential portion. The claws are inserted in the slit grooves. In the present embodiment, the rotatable friction plates 56 constitute a first friction plate configured to rotate together with the oscillatory rotating body 30, and the stationary friction plates 55 constitute a second friction plate prevented from rotating by the second or first block. In the present embodiment, the stationary friction plates 55 serving as the second friction plate are prevented from rotating by the stationary block 16 serving as the second block.

The stationary and rotatable friction plates 55 and 56 are alternately arranged next to each other in the axial direction within the space defined in the device housing hole 36 by the rotation converting block 28. When the last friction plate 55 on the first direction side is acted upon from outside by a pressing force directed toward the second direction, the alternately arranged stationary and rotatable friction plates 55 and 56 frictionally touch each other at their opposing surfaces. The pressing force thus produces a brake force to act on the rotation converting block 28. Here, the rotation converting block 28 is configured to rotate in response to the oscillatory rotation of the oscillatory rotating body 30. Therefore, the oscillatory rotation of the oscillatory rotating body 30 is braked by the braking effect realized by the stationary and rotatable friction plates 55 and 56.

The spline block 37, which is substantially shaped like a circular tube, has a plurality of insertion holes 49 extending through the spline block 37 in the axial direction. The insertion holes 49 are arranged at equal intervals in the circumferential direction, for example. The insertion holes 49 receive pressing rods 50 such that they are movable in the axial direction. The pressing rods 50 have a greater length in the axial direction than the spline block 37. Each pressing rod 50 is configured such that its end facing the first direction can abut against the end surface of the press plate 40 placed in the plate housing chamber 39. Each pressing rod 50 is configured such that its end facing the second direction can abut against the last friction plate 55 on the first direction side via an intervening member such as a washer.

While the hydraulic motor 15 is in operation, the hydraulic fluid flows from the channel block 19 at a high pressure into the pressure inlet channel 44. As a result, the piston 42 overcomes the force applied by the bias spring 98 and moves toward the first direction together with the press plate 40, as described above. The press plate 40 then moves away from the ends of the pressing rods 50, and no frictional resistance is created between the stationary and rotatable friction plates 55 and 56. No brake force thus acts on the oscillatory rotating body 30. The oscillatory rotating body 30 is allowed to freely oscillatorily rotate.

On the other hand, while the hydraulic motor 15 is suspended from operating, the high pressure of the hydraulic fluid no longer acts on the pressure inlet channel 44. Therefore, the bias force produced by the bias spring 98 moves the press plate 40 toward the second direction. As a result, the friction plates 55 and 56 are pressed against each other via the pressing rods 50. Thus, frictional resistance is generated between the stationary and rotatable friction plates 55 and 56, thereby braking the rotation of the rotation converting block 28. This results in braking the oscillatory rotation of the oscillatory rotating body 30.

In the present embodiment, the press plate 40 and pressing rods 50 constitute a press member configured to apply a press force to the rotatable friction plates 56 (first friction plate) and stationary friction plates 55 (second friction plate). The bias spring 98 constitutes a bias device configured to bias the press member. The piston device 45 constitutes a brake release device configured to move the press member in such a direction that the frictional contact between the rotatable friction plates 56 (first friction plate) and the stationary friction plates 55 (second friction plate) is undone. In the present embodiment, a press mechanism is constituted by the press plate 40 and pressing rods 50 serving as the press member, the bias spring 98 serving as the bias device, and the piston device 45 serving as the brake release device. The press mechanism constitutes a brake mechanism 48 relating to the present embodiment when combined with the stationary and rotatable friction plates 55 and 56.

The rotation restricting shaft 32 is disposed in the hydraulic motor 15 in the middle region in the axial direction while meshing with the spline hole 38 in the spline block 37, which is disposed in the stationary block 16 in the substantially middle portion in the axial direction, and also meshing with the spline hole 31 in the oscillatory rotating body 30. In the hydraulic motor 15 relating to the present embodiment, the main constituents of the brake mechanism 48 are arranged in the region surrounding the rotation restricting shaft 32. Specifically, in the region surrounding the rotation restricting shaft 32, the stationary friction plates 55, rotatable friction plates 56, and part of the pressing rods 50 are disposed. In the region surrounding the rotation restricting shaft 32, the stationary friction plates 55, rotatable friction plates 56, and some of the pressing rods 50 overlap the rotation restricting shaft 32 in the axial direction.

The following now describes how the hydraulic motor 15 works. The hydraulic fluid in the feeding channel 24 flows sequentially into the working chambers 35*a* and 35*b* through the slidable plate 23 and feeding and discharging plate 18P. The pressure created by the hydraulic fluid causes the oscillatory rotating body 30 to oscillatorily rotate in a predetermined direction. Since the external teeth 30*a* of the oscillatory rotating body 30 engage with the internal tooth pins 22 of the first tubular portion 18F, the first tubular portion 18F follows the oscillatory rotation of the oscillatory rotating body 30 and rotates at a speed reduced by a predetermined reduction ratio. As a result, the output rotatable block 18 including the first tubular portion 18F rotates at the speed reduced by the predetermined reduction ratio.

In the hydraulic motor 15 relating to the present embodiment, the block (18) corresponding to the first block including the block inner circumferential portion and the plurality of internal teeth provided on the block inner circumferential portion serves as the output rotatable block, and the block (16) corresponding to the second block, which is coupled with the oscillatory rotating body 30 via the rotation restricting shaft 32, serves as the stationary block. However, the block (18) corresponding to the first block including the block inner circumferential portion and the plurality of internal teeth provided on the block inner circumferential portion may serve as the stationary block, and the block (16) corresponding to the second block, which is coupled with the oscillatory rotating body 30 via the rotation restricting shaft 32, may serve as the output rotatable block. In this case, the block corresponding to the output rotatable block 18 shown in FIG. 2 is fixedly attached to the main body of the construction machine. In this case, as the hydraulic fluid is fed to and discharged from the working chambers 35*a* and 35*b*, the rotation of the oscillatory rotating body 30 on its own axis is transmitted via the rotation restricting shaft 32 to the block corresponding to the stationary block 16 shown in FIG. 2. The block equivalent to the stationary block 16 shown in FIG. 2 then rotates at the speed reduced by a predetermined reduction ratio, and the rotation is output.

Note that the block corresponding to the first block, which includes the block inner circumferential portion and the plurality of internal teeth provided on the block inner circumferential portion, may serve as the stationary block. The block corresponding to the second block, which is coupled with the oscillatory rotating body 30 via the rotation restricting shaft 32, may serve as the output rotatable block. These features of the stationary and output rotatable blocks may also apply to the following embodiments and modification examples.

As described above, in the hydraulic motor 15 relating to the present embodiment, the brake mechanism 48 includes the rotatable friction plates 56 (first friction plate), stationary friction plates 55 (second friction plate), and press mechanism (press plate 40, pressing rods 50, bias spring 98, piston device 45 and the like). In the hydraulic motor 15, the oscillatory rotation of the oscillatory rotating body 30 is braked by the press mechanism pressing the stationary and rotatable friction plates 55 and 56 against each other. Accordingly, the hydraulic motor 15 relating to the present embodiment can smoothly and reliably apply and remove a brake force onto the oscillatory rotating body 30.

In the hydraulic motor 15 relating to the present embodiment, the stationary and rotatable friction plates 55 and 56 are annularly shaped and provided in the region surrounding the rotation restricting shaft 32. Accordingly, a large braking torque can be efficiently produced in the region surrounding the rotation restricting shaft 32.

The hydraulic motor 15 relating to the present embodiment includes the rotation converting block 28 configured to extract the oscillation component of the rotation of the oscillatory rotating body 30 as the synchronous rotation about the first axis c1. The rotatable friction plates 56 of the brake mechanism 48 are supported by the rotation converting block 28 in such a manner that the rotatable friction plates 56 are not allowed to rotate relative to the rotation converting block 28. Accordingly, the oscillation component of the rotation of the oscillatory rotating body 30 can be extracted as the rotation of the rotation converting block 28, and the brake mechanism 48 can apply a braking force onto the rotation converting block 28. In this case, the required braking torque can be reduced when compared with the case where the braking torque is directly applied to the oscillatorily rotating oscillatory rotating body 30. Accordingly, the brake mechanism 48 can be reduced in size by employing the present embodiment.

In the hydraulic motor 15 relating to the present embodiment, the press mechanism of the brake mechanism 48 is constituted by the press member (the press plate 40 and pressing rods 50), the bias device (bias spring 98) configured to bias the press member in the braking direction, and the brake release device (piston device 45) configured to move the press member in the brake release direction. Thus, the oscillatory rotating body 30 can be reliably braked and the braking can be reliably released in a simplified manner in the present embodiment.

In the hydraulic motor 15 relating to the present embodiment, the brake release device is constituted by the piston device 45 configured to move the press member in the friction removing direction using the pressured produced by the introduced hydraulic fluid. While the hydraulic motor 15 is in operation, the force created by the hydraulic fluid rises and the braking applied onto the oscillatory rotating body 30 is automatically released. While the hydraulic motor 15 is suspended from operating, the force created by the hydraulic fluid drops and the oscillatory rotating body 30 is reliably braked. By employing the present embodiment, users are thus not required to do something special to brake the oscillatory rotating body 30 and release the braking and can enjoy convenience.

In the hydraulic motor 15 relating to the present embodiment, (at least some of) the main constituents of the brake mechanism 48 are disposed in the region surrounding the rotation restricting shaft 32. The main constituents of the brake mechanism 48 are disposed in a sufficiently spacious region, to be specific, in the region externally surrounding the rotation restricting shaft 32. In this manner, while an increase in the overall size of the hydraulic motor 15 is prevented, the brake mechanism 48 can have an increased volume. Accordingly, the hydraulic motor 15 relating to the present embodiment can smoothly and reliably apply and remove a brake force onto the oscillatory rotating body 30.

Modification Examples

Figure 4:
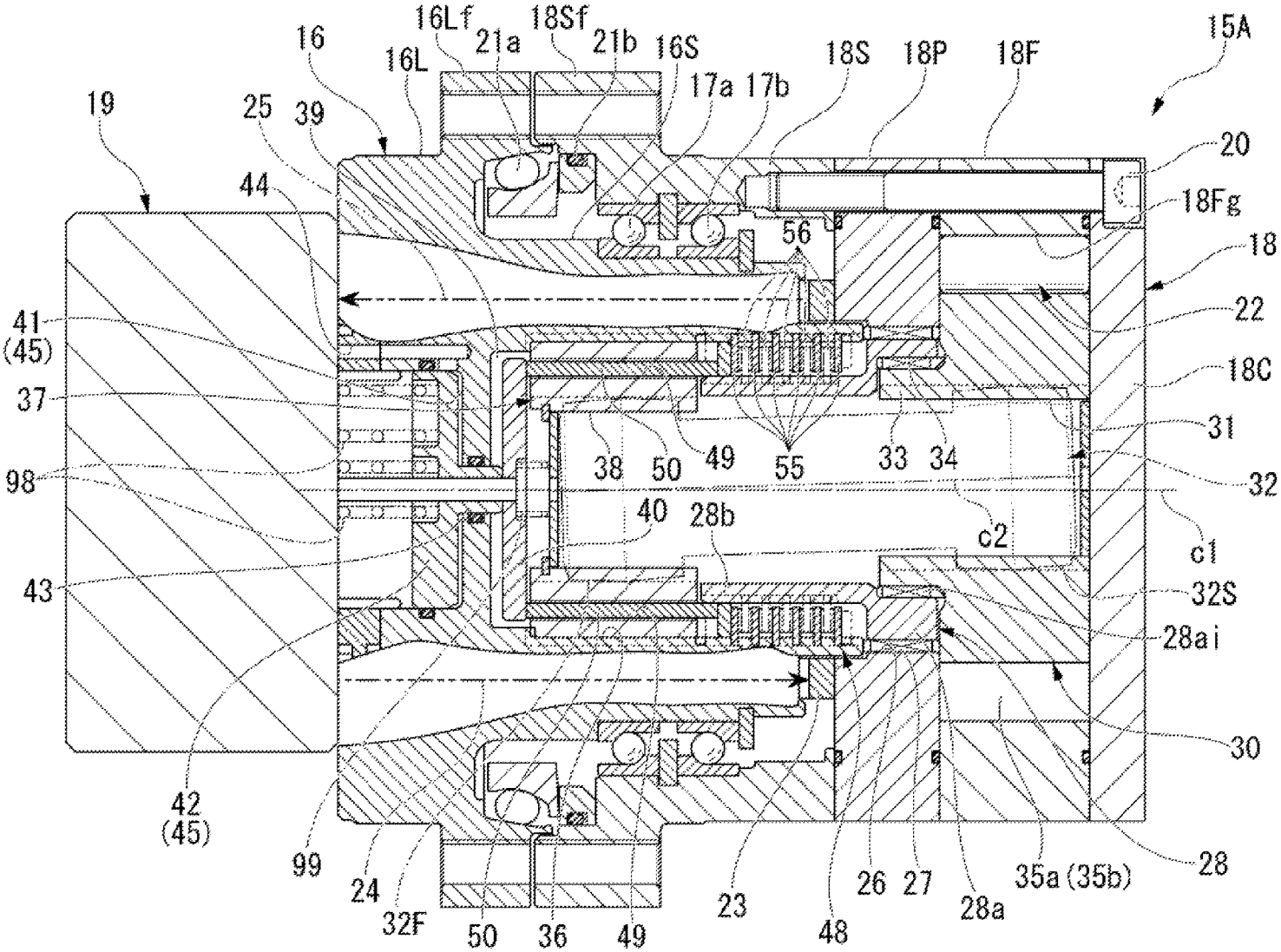
FIG. 4 is a vertical sectional view showing a hydraulic motor (hydraulic device) relating to a modification example of the first embodiment.

FIG. 4 is a vertical sectional view showing a hydraulic motor (hydraulic device) according to a modification example. A hydraulic motor 15A relating to the present modification example is basically configured in substantially the same manner as the hydraulic motor 15 relating to the above-described embodiment. In the above-described embodiment, the bias spring 98 is disposed together with the press plate in the plate housing chamber 39 defined within the stationary block 16. According to the present modification example, the bias spring 98 is disposed in the cylinder chamber 41 behind the piston 42 (on the first direction side with respect to the piston 42).

According to the present modification example, a plurality of bias springs 98 can be contained in a limited space when compared with the case where the bias spring 98 surrounds the coupling rod 43 in the plate housing chamber 39 (see FIG. 2). Accordingly, the hydraulic motor 15A relating to the present modification example can achieve a reduced size.

Second Embodiment

Figure 5:
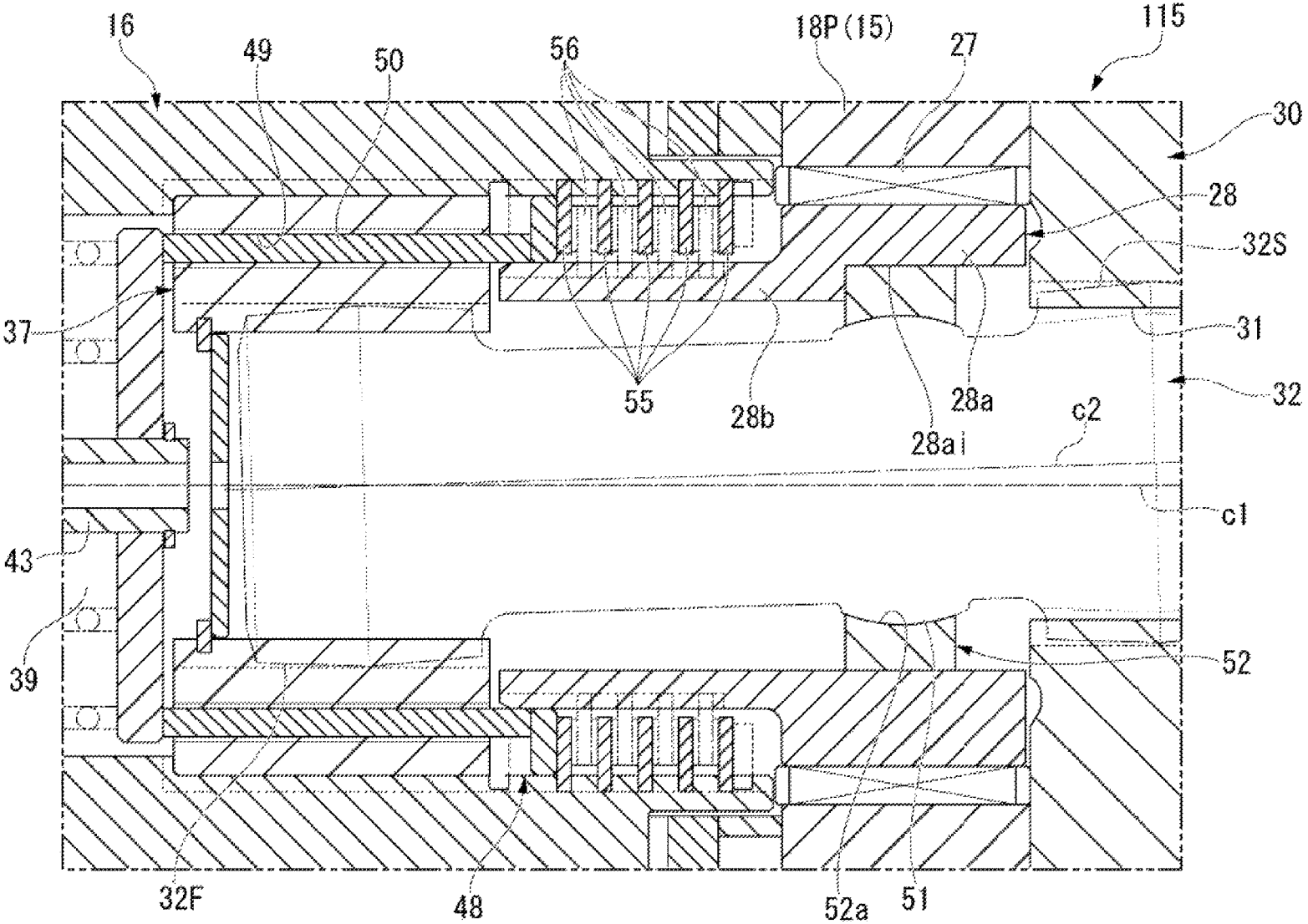
FIG. 5 is a vertical sectional view showing part of a hydraulic motor (hydraulic device) according to a second embodiment.

FIG. 5 is a vertical sectional view showing part of a hydraulic motor (hydraulic device) according to a second embodiment. A hydraulic motor 115 relating to the present embodiment is basically configured in substantially the same manner as the hydraulic motor 15 relating to the above-described first embodiment. The second embodiment is different from the first embodiment in terms of how the rotation converting block 28 configured to extract the oscillatory rotation of the oscillatory rotating body 30 as the synchronous rotation about the first axis c1 is arranged and how to extract the rotation. Specifically, according to the first embodiment, the end of the oscillatory rotating body 30 has the boss 33, and the eccentric inner circumferential surface 28*ai* of the rotation converting block 28 is rotatably supported by the outer circumferential surface of the boss 33. According to the second embodiment, on the other hand, the outer circumferential surface of the rotation restricting shaft 32 has a spherically raised portion 51 in its half facing the second direction, and a plain bearing 52 having a recessed spherical inner surface is fixedly mounted on the inner surface 28*ai* of the large diameter tubular portion 28*a* of the rotation converting block 28.

The plain bearing 52 is fixedly mounted on the inner surface 28*ai* of the large diameter tubular portion 28*a* that is centered on a point shifted in the radial direction from the first axis c1. The plain bearing 52 has a recessed spherical surface. The plain bearing 52 has a recessed spherical inner surface 52*a*. The surface 52*a* is in contact with the raised portion 51 of the rotation restricting shaft 32 with sliding being allowed between them. The sliding on the spherical surface 52*a* allows the rotation restricting shaft 32 to yaw. In the present embodiment, the plain bearing 52 and rotation converting block 28 are configured to extract the oscillatory rotation of the raised portion 51 of the rotation restricting shaft 32 as the synchronous rotation about the first axis c1.

The hydraulic motor 115 relating to the second embodiment is different from the hydraulic motor 15 relating to the first embodiment in terms of how the rotation converting block 28 is arranged and how to extract the oscillation component. Except for that, the hydraulic motor 115 is the same as the hydraulic motor 15 relating to the first embodiment. Therefore, the hydraulic motor 115 of the second embodiment can also produce the same advantageous effects as the hydraulic motor 15 relating to the above-described first embodiment.

Third Embodiment

Figure 6:
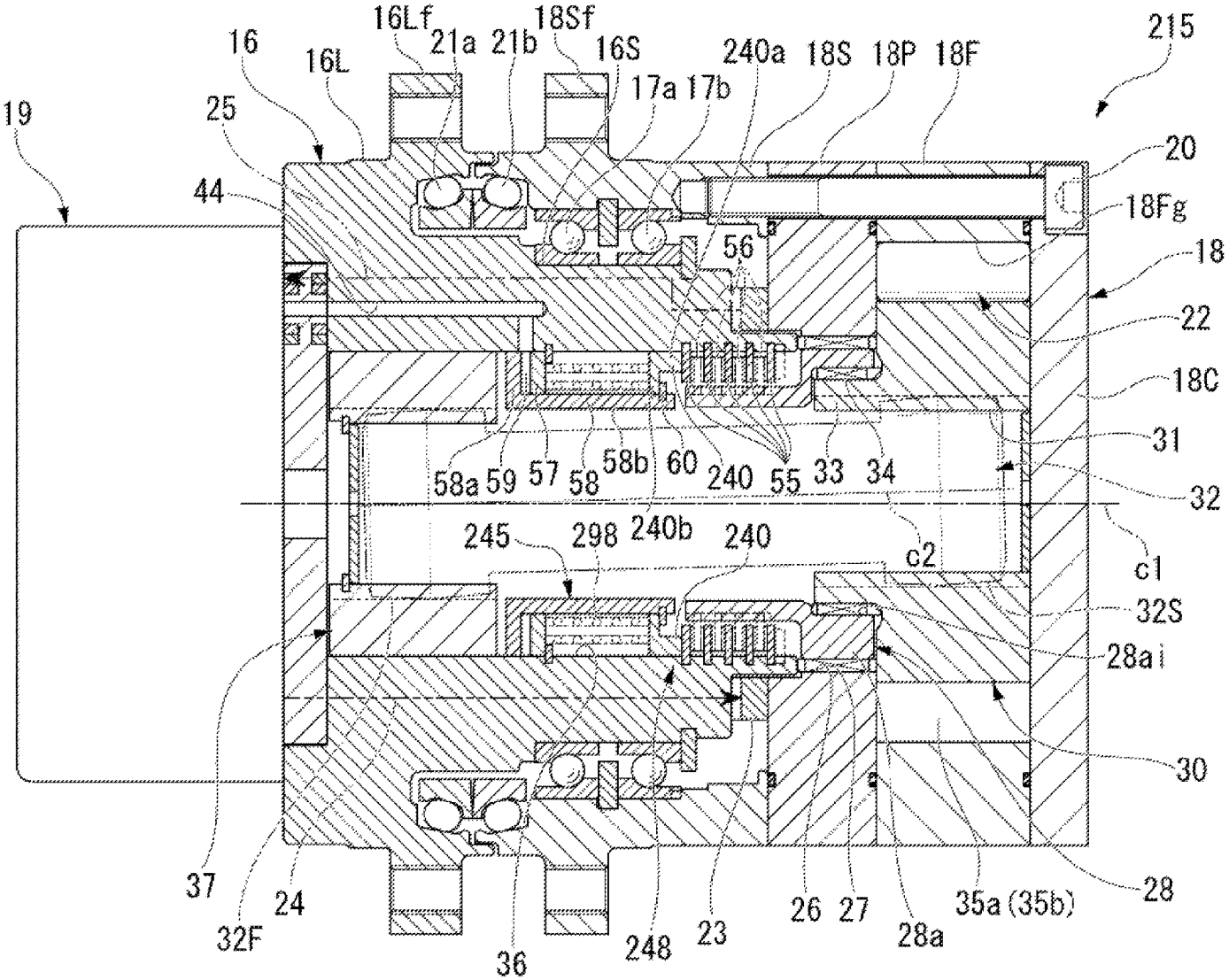
FIG. 6 is a vertical sectional view showing a hydraulic motor (hydraulic device) according to a third embodiment.
Figure 7:
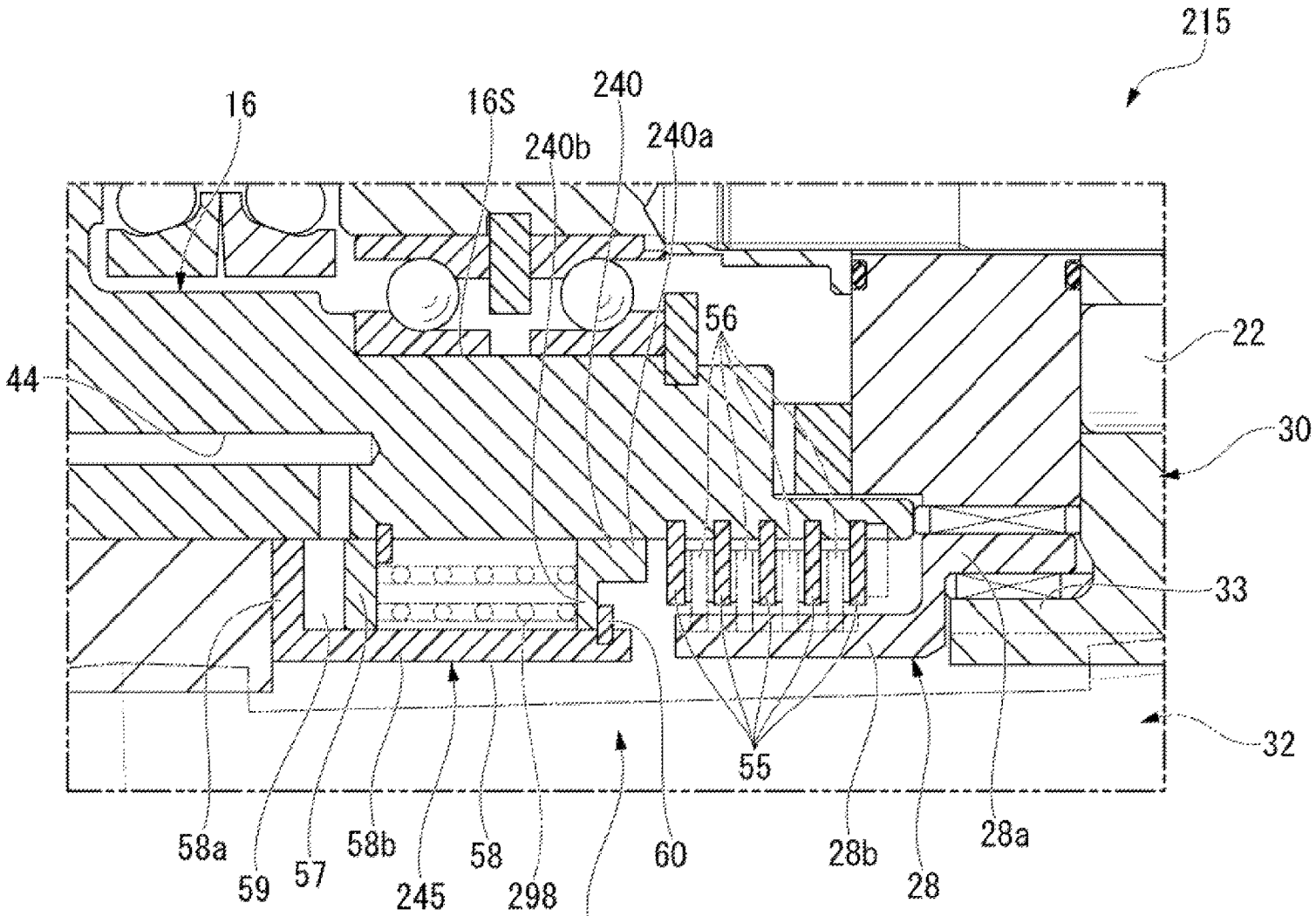
FIG. 7 is a vertical sectional view showing part of the hydraulic motor (hydraulic device) according to the third embodiment in a brake released state.

FIG. 6 is a vertical sectional view showing a hydraulic motor (hydraulic device) according to a third embodiment. FIG. 7 is an enlarged view of the main part of FIG. 6 and shows how the hydraulic motor works. FIG. 6 illustrates the brake mechanism in operation. FIG. 7 illustrates the brake mechanism suspended. A hydraulic motor 215 relating to the present embodiment is basically configured in substantially the same manner as the hydraulic motor 15 relating to the above-described first embodiment. The third embodiment is different from the first embodiment in terms of the press mechanism of the brake mechanism 248. The rotatable friction plates 56 (first friction plate) and stationary friction plates 55 (second friction plate) are the same as in the first embodiment.

The press mechanism is constituted by a press plate 240 serving as the press member, a bias spring 298 configured to bias the press plate 240 in the braking direction, and a piston device 245 (brake release device) configured to move the press plate 240 in the brake release direction. In the device housing hole 36 defined in the stationary block 16, the press mechanism is disposed in the region facing the second direction with respect to the spline block 37.

The piston device 245 includes an annular stationary wall 57 fixedly attached to the inner surface of the device housing hole 36 and a tubular piston 58 having an end flange 58*a*. The tubular piston 58 has a tubular wall 58*b* and the end flange 58*a*. The tubular wall 58*b* is in slidable contact with the inner circumferential surface of the stationary wall 57, and the end flange 58*a* projects radially outwardly from the end of the tubular wall 58*b* facing the first direction. The tubular piston 58 is assembled in the device housing hole 36 such that the outer circumferential surface of the end flange 58*a* is in slidable contact with the inner circumferential surface of the device housing hole 36. The space defined between the end flange 58*a* of the tubular piston 58 and the stationary wall 57 is referred to as a piston chamber 59 into which the hydraulic fluid flows through the pressure inlet channel 44.

The press plate 240 has an annular tubular portion 240*a* and a restricting flange 240*b* projecting radially inward from the end of the tubular portion 240*a* that faces the first direction. The restricting flange 240*b* surrounds the outer periphery of the tubular piston 58. The press plate 240 is configured not to move further in the second direction beyond a stopper ring 60 fixedly attached to the end of the outer periphery of the tubular piston 58 that faces the second direction.

The bias spring 298 is disposed between the stationary wall 57 of the piston device 245 and the press plate 240. The end of the tubular portion 240*a* of the press plate 240 is configured to abut against the last friction plate 55 on the first direction side. The bias spring 298 biases the press plate 240 in such a direction that the friction plates 55 and 56 are pressed against each other.

While the hydraulic motor 215 is suspended from operating, the high-pressure hydraulic fluid does not flow into the piston chamber 59 thorough the pressure inlet channel 44. Thus, as shown in FIG. 6, the bias spring 298 applies a press force to the stationary and rotatable friction plates 55 and 56 via the press plate 240. This results in braking the rotation of the rotation converting block 28, thereby braking the oscillatory rotation of the oscillatory rotating body 30.

As the hydraulic motor 215 starts operating, the high-pressure hydraulic fluid flows into the piston chamber 59 through the pressure inlet channel 44. As a result, as shown in FIG. 7, the pressure applied by the hydraulic fluid causes the tubular piston 58 to overcome the bias force applied by the bias spring 298 and to retreat. As a result, no frictional force is exerted between the stationary and rotatable friction plates 55 and 56, thereby allowing the rotation converting block 28 and oscillatory rotating body 30 to freely rotate.

The hydraulic motor 215 relating to the third embodiment is basically configured in substantially the same manner as the hydraulic motor 15 relating to the first embodiment and can basically produce the same effects as the hydraulic motor 15 relating to the first embodiment. In the hydraulic motor 215 relating to the present embodiment, as well as the stationary and rotatable friction plates 55 and 56, the piston device 245 and bias device (bias spring 298) of the brake mechanism 248 are provided in the region surrounding the rotation restricting shaft 32. This means that the main constituents of the brake mechanism 248 overlap the rotation restricting shaft 32 in the axial direction. Accordingly, the hydraulic motor 215 relating to the present embodiment can have a reduced overall size in the axial direction.

Modification Examples

Figure 8A:
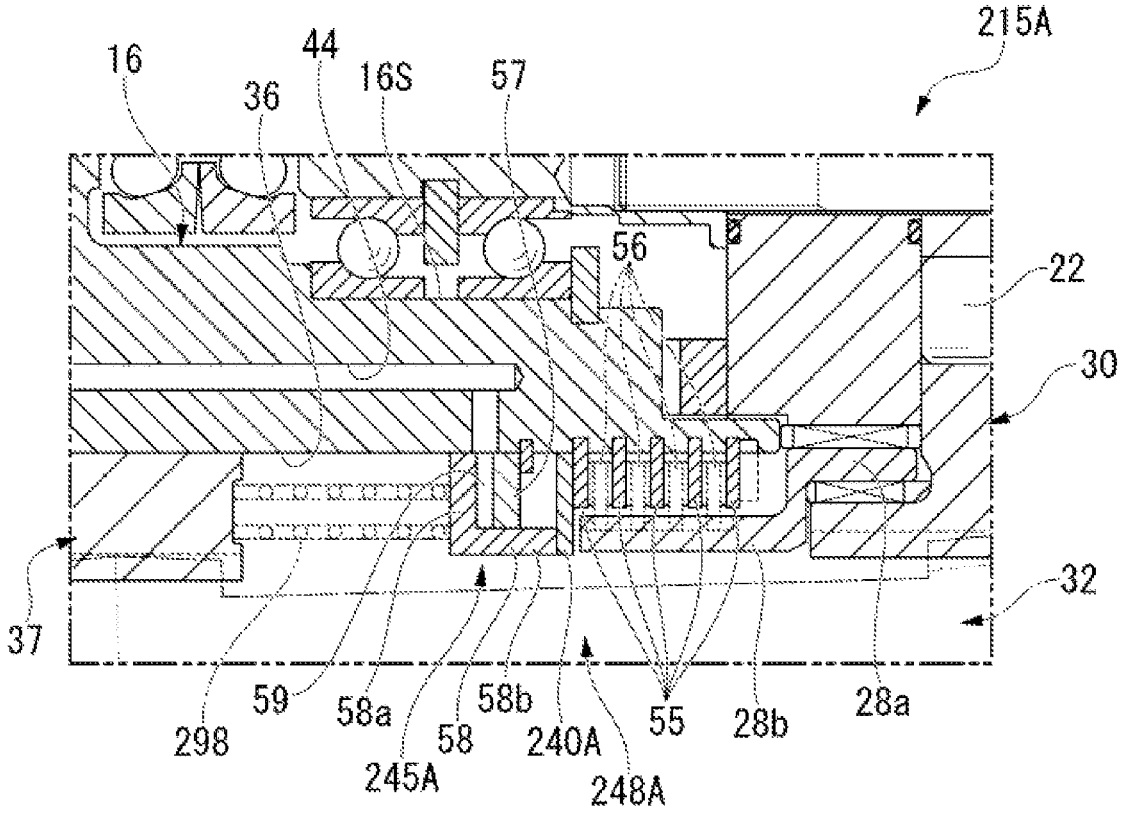
FIG. 8A is a vertical sectional view showing part of a hydraulic motor (hydraulic device) relating to a modification example of the third embodiment.
Figure 8B:
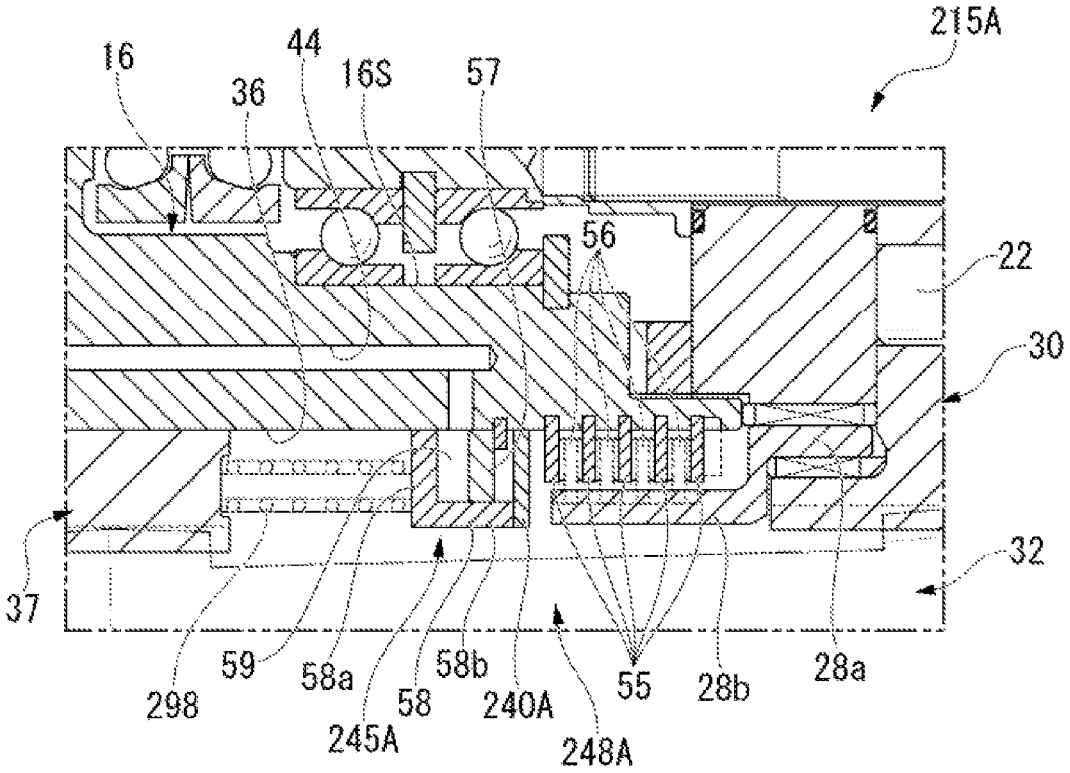
FIG. 8B is a vertical sectional view showing part of the hydraulic motor (hydraulic device) relating to the modification example of the third embodiment.

FIGS. 8A and 8B are vertical sectional views showing part of a hydraulic motor 215A (hydraulic device) according to a modification example of the third embodiment. FIG. 8A illustrates a brake mechanism 248A in operation. FIG. 8B illustrates the brake mechanism 248A suspended. The hydraulic motor 215A relating to the present modification example is basically configured in substantially the same manner as the hydraulic motor 215 relating to the above-described third embodiment but slightly different in terms of the configuration of the brake mechanism 248A.

While the bias spring 298 is arranged between the stationary wall 57 and the press plate 240 in the third embodiment, the bias spring 298 is arranged between the spline block 37 and the tubular piston 58 of the piston device 245A in the present modification example. The press plate 240A is fixedly attached to or configured to abut against the end surface of the tubular piston 58 facing the second direction. The present modification example can also produce the same effects as the above-described third embodiment.

Fourth Embodiment

Figure 9:
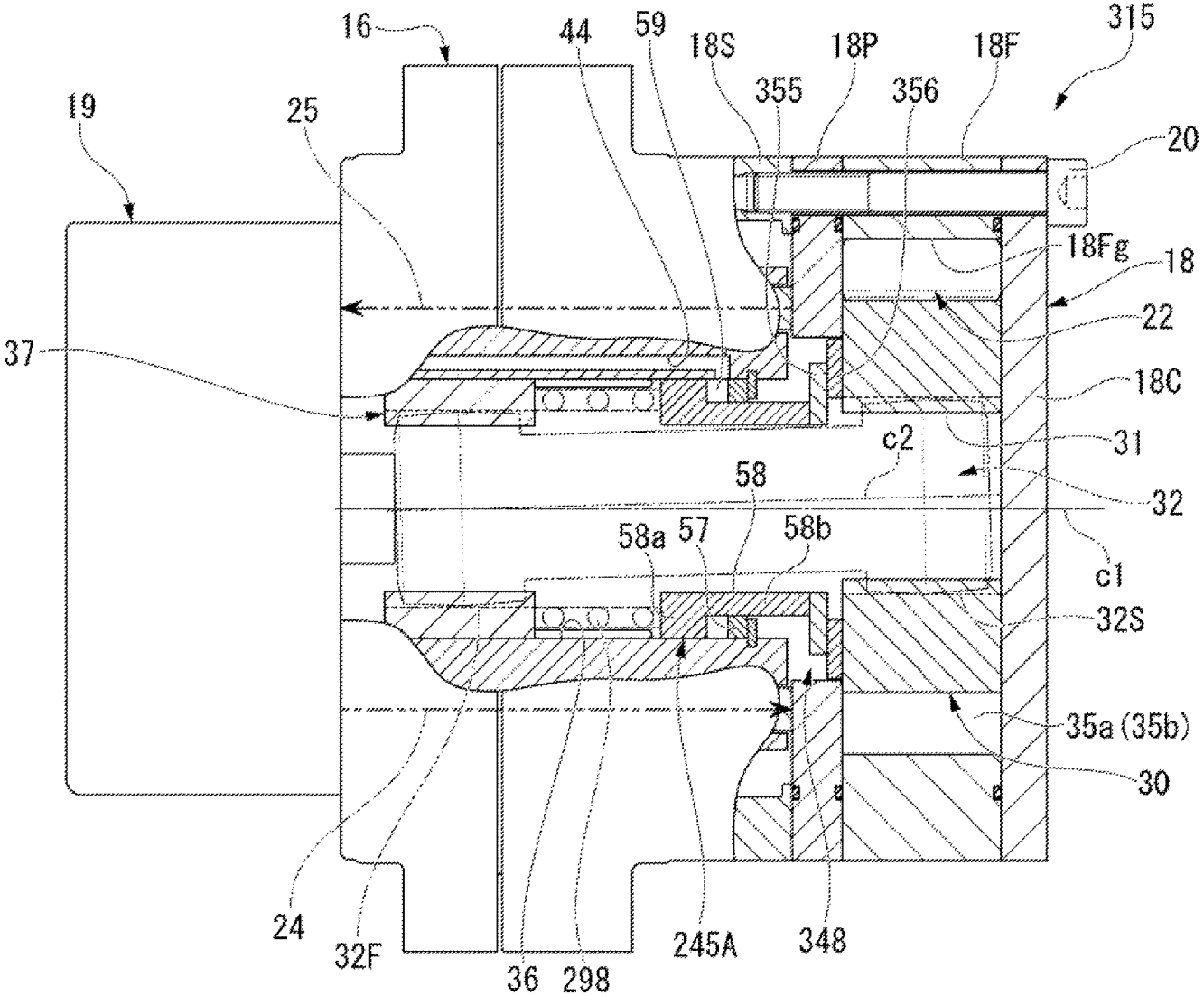
FIG. 9 is a vertical sectional view showing a hydraulic motor (hydraulic device) according to a fourth embodiment.
Figure 10:
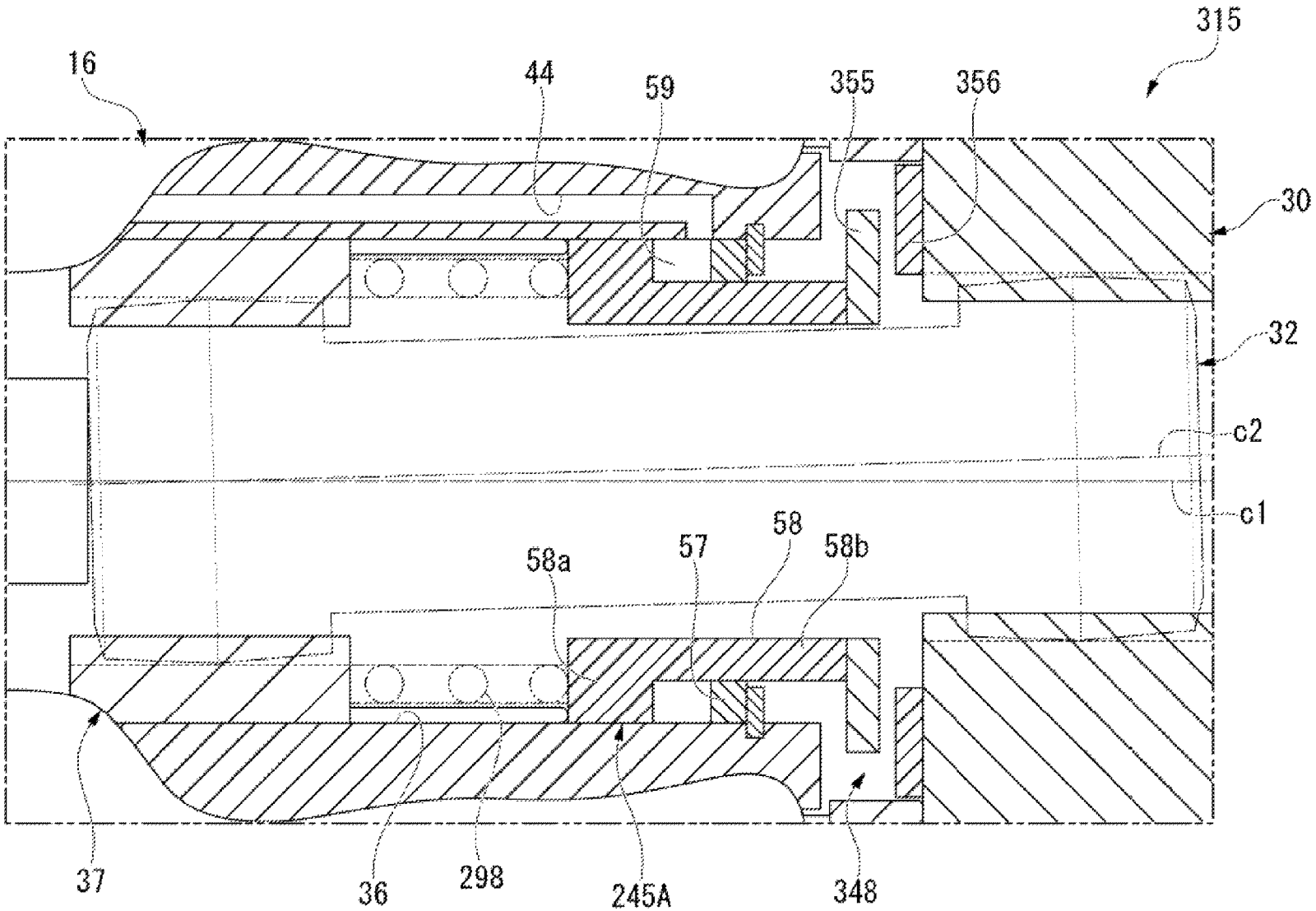
FIG. 10 is a vertical sectional view showing part of the hydraulic motor (hydraulic device) according to the fourth embodiment in a brake released state.

FIG. 9 is a vertical sectional view showing a hydraulic motor 315 (hydraulic device) according to a fourth embodiment. FIG. 10 is an enlarged view of the main part of FIG. 9 and shows how the hydraulic motor 315 works. FIG. 9 illustrates a brake mechanism 348 in operation. FIG. 10 illustrates the brake mechanism 348 being suspended. Except for the brake mechanism 348, the hydraulic motor 315 relating to the fourth embodiment is configured in substantially the same manner as the hydraulic motor 15 relating to the above-described first embodiment. In the hydraulic motor 315 relating to the fourth embodiment, a friction plate 356 of the brake mechanism 348 (first friction plate) is fixedly fastened using bolts or the like onto the end surface of the oscillatory rotating body 30 in the axial direction. The hydraulic motor 315 relating to the present embodiment is implemented without the rotation converting block configured to extract the oscillatory rotation of the oscillatory rotating body 30 as the synchronous rotation about the first axis c1.

The brake mechanism 348 includes a friction plate 356 (first friction plate), a friction plate 355 (second friction plate) and a press mechanism. The press mechanism is configured to press the rotatable friction plates 356 and 355. The press mechanism includes a bias spring 298 and a piston device 245A, which are configured in the same manner as those in the modification example of the third embodiment.

The piston device 245A includes an annular stationary wall 57 fixedly attached to the inner surface of the device housing hole 36 and a tubular piston 58 having an end flange 58*a*. The stationary wall 57 is fixedly attached to a portion of the device housing hole 36 near its end facing the second direction.

The tubular piston 58 has a tubular wall 58*b* and the end flange 58*a*. The tubular wall 58*b* is in slidable contact with the inner circumferential surface of the stationary wall 57, and the end flange 58*a* projects radially outwardly from the end of the tubular wall 58*b* facing the first direction. The tubular piston 58 is assembled in the device housing hole 36 such that the outer circumferential surface of the end flange 58*a* is in slidable contact with the inner circumferential surface of the device housing hole 36. The space defined between the end flange 58*a* of the tubular piston 58 and the stationary wall 57 is referred to as a piston chamber 59 into which the hydraulic fluid flows through the pressure inlet channel 44.

The annular friction plate 355 is fixedly fastened using bolts or the like onto the end surface of the tubular wall 58*b* of the tubular piston 58 facing the second direction. The end surface (facing the second direction) of the friction plate 355 fixedly attached to the tubular wall 58*b* faces the end surface (facing the first direction) of the friction plate 356 fixedly attached to the end surface of the oscillatory rotating body 30. In the present embodiment, a portion of the tubular wall 58*b* of the tubular piston 58 also serves as a press member.

The bias spring 298 is disposed between the spline block 37 and the end flange 58*a* of the tubular piston 58 and configured to bias the tubular piston 58 toward the second direction. The bias spring 298 biases the tubular piston 58 in such a manner that the friction plate 355 attached to the tubular piston 58 may be pressed against the friction plate 356.

While the hydraulic motor 315 is suspended from operating, the high-pressure hydraulic fluid does not flow into the piston chamber 59 thorough the pressure inlet channel 44. Thus, as shown in FIG. 9, the bias spring 298 presses the friction plate 355 against the friction plate 356 via the tubular piston 58. As a result, a frictional force is exerted between the stationary and rotatable friction plates 355 and 356, thereby braking the oscillatory rotation of the oscillatory rotating body 30.

As the hydraulic motor 315 starts operating, the high-pressure hydraulic fluid flows into the piston chamber 59 through the pressure inlet channel 44. As a result, as shown in FIG. 10, the pressure applied by the hydraulic fluid causes the tubular piston 58 to overcome the bias force applied by the bias spring 298 and to move backward. As a result, no frictional force is exerted between the stationary and rotatable friction plates 355 and 356, thereby allowing the oscillatory rotating body 30 to freely rotate.

The hydraulic motor 315 relating to the fourth embodiment is basically configured in substantially the same manner as the hydraulic motor 15 relating to the first embodiment and can basically produce the same effects as the hydraulic motor 15 relating to the first embodiment. The hydraulic motor 315 relating to the fourth embodiment, however, is configured such that the braking torque may be directly applied to the oscillatory rotating body 30 configured to oscillatorily rotate. The hydraulic motor 315 relating to the fourth embodiment can thus achieve a smaller number of parts than the hydraulic motor including the rotation converting block. Accordingly, the hydraulic motor 315 relating to the present embodiment can achieve a reduced cost.

Fifth Embodiment

Figure 11:
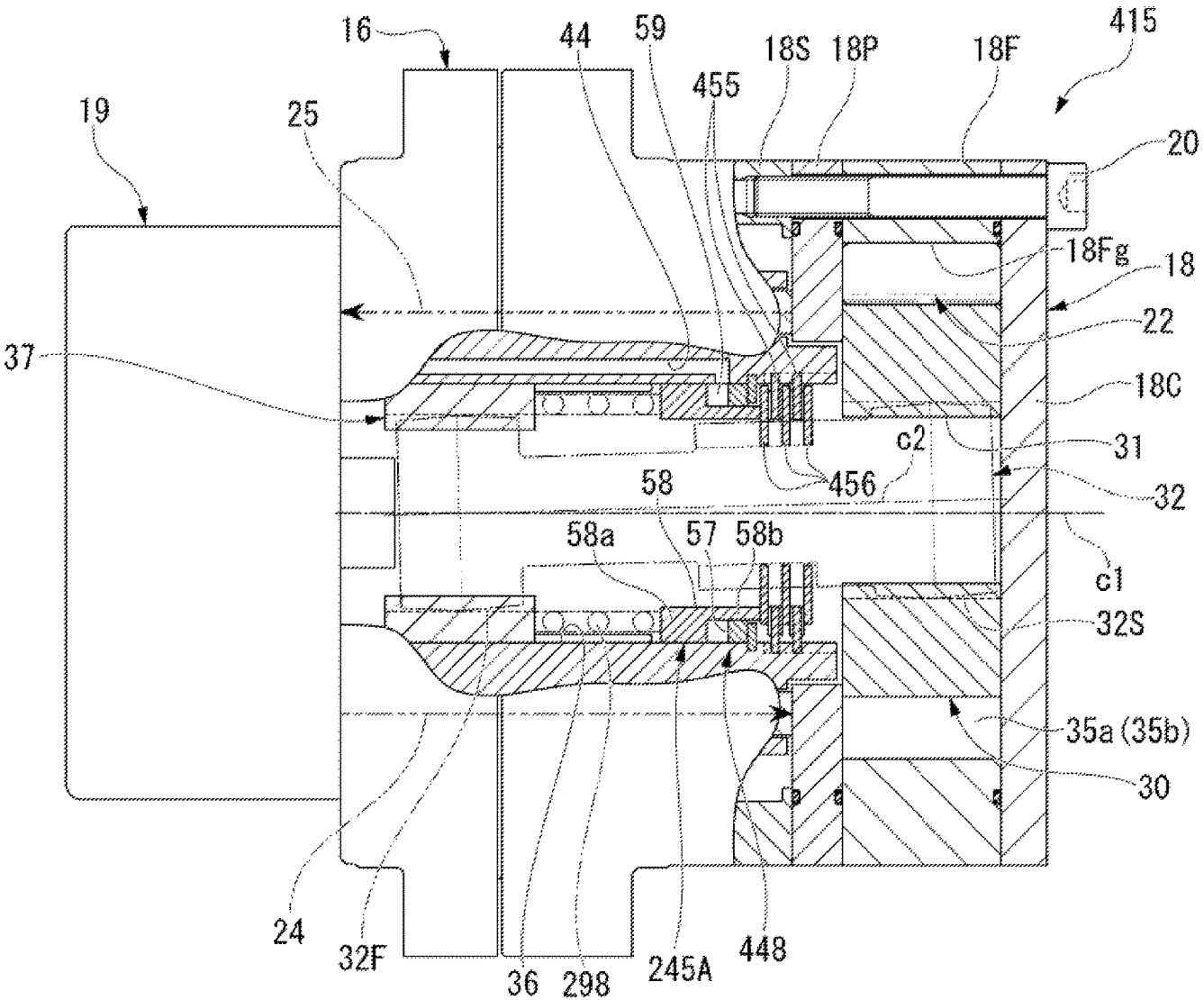
FIG. 11 is a vertical sectional view showing a hydraulic motor (hydraulic device) according to a fifth embodiment.
Figure 12:
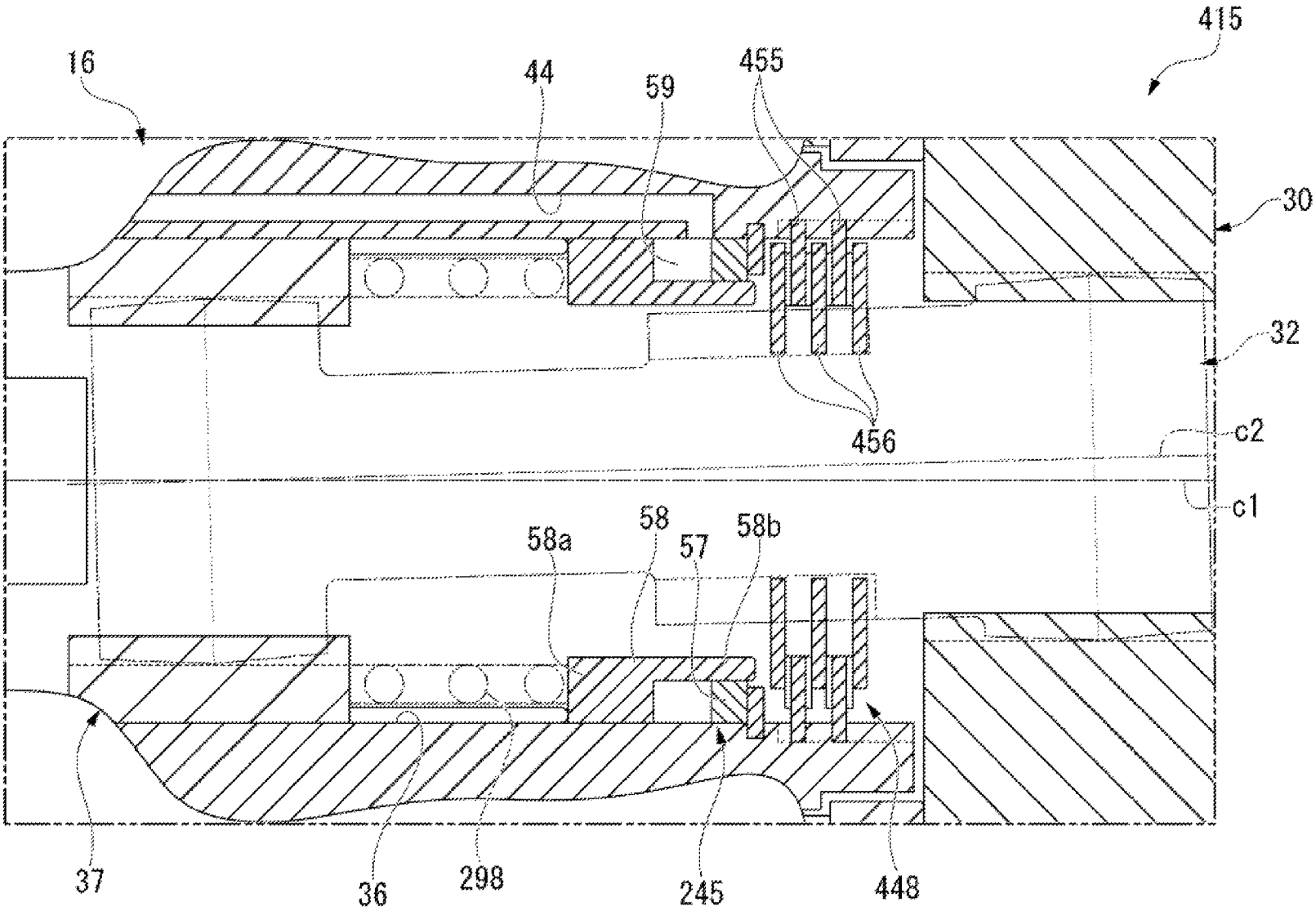
FIG. 12 is a vertical sectional view showing part of a hydraulic motor (hydraulic device) according to the fifth embodiment in a brake released state.

FIG. 11 is a vertical sectional view showing a hydraulic motor 415 (hydraulic device) according to a fifth embodiment. FIG. 12 is an enlarged view of the main part of FIG. 11 and shows how the hydraulic motor 415 works. FIG. 11 illustrates the brake mechanism in operation. FIG. 12 illustrates the brake mechanism suspended. Except for the brake mechanism 448, the hydraulic motor 415 relating to the fifth embodiment is also configured in substantially the same manner as the hydraulic motor 15 relating to the above-described first embodiment. In the hydraulic motor 415 relating to the fifth embodiment, a plurality of rotatable friction plates 456 (first friction plate) of the brake mechanism 448 are attached to the outer periphery of the rotation restricting shaft 32. A plurality of stationary friction plates 455 (second friction plate) of the brake mechanism 448 are attached to the inner circumferential surface of the device housing hole 36 in the stationary block 16 as in the first embodiment. The hydraulic motor 415 relating to the present embodiment is also implemented without the rotation converting block configured to extract the oscillatory rotation of the oscillatory rotating body 30 as the synchronous rotation about the first axis c1.

As in the first embodiment, the stationary friction plates 455 are mounted on the inner circumferential portion of the device housing hole 36 such that they are movable in the axial direction but not allowed to rotate relative to the inner circumferential portion. Specifically, the inner circumferential surface of the device housing hole 36 has a plurality of slit grooves along the axial direction, for example, and the stationary friction plates 455 have a plurality of claws on their outer circumferential portion. The claws are inserted in the slit grooves.

The rotatable friction plates 456 are mounted on the outer circumferential portion of the rotation restricting shaft 32 such that they are movable in the axial direction but not allowed to rotate relative to the outer circumferential portion. Likewise, specifically, the outer circumferential surface of the rotation restricting shaft 32 has a plurality of slit grooves along the axial direction, for example, and the rotatable friction plates 456 have a plurality of claws on their inner circumferential portion. The claws are inserted in the slit grooves.

The press mechanism constituting part of the brake mechanism 448 includes the bias spring 298 and piston device 245A, which are configured in the same manner as in the fourth embodiment. The piston device 245A is not described in detail here for the sake of brevity. The end of the tubular wall 58*b* of the tubular piston 58 that faces the second direction also serves as a press member.

While the hydraulic motor 415 is suspended from operating, the high-pressure hydraulic fluid does not flow into the piston chamber 59 thorough the pressure inlet channel 44. Thus, as shown in FIG. 11, the bias spring 298 applies a press force to the stationary and rotatable friction plates 455 and 456 via the tubular piston 58. As a result, a frictional force is exerted between the stationary and rotatable friction plates 455 and 456, thereby braking the oscillatory rotation of the oscillatory rotating body 30 and rotation restricting shaft 32.

As the hydraulic motor 415 starts operating, the high-pressure hydraulic fluid flows into the piston chamber 59 through the pressure inlet channel 44. As a result, as shown in FIG. 12, the pressure applied by the hydraulic fluid causes the tubular piston 58 to overcome the bias force applied by the bias spring 298 and to move backward. As a result, no frictional force is exerted between the stationary and rotatable friction plates 455 and 456, thereby allowing the oscillatory rotating body 30 and rotation restricting shaft 32 to freely rotate.

The hydraulic motor 415 relating to the fifth embodiment is basically configured in substantially the same manner as the hydraulic motor 15 relating to the first embodiment and can thus basically produce the same effects as the hydraulic motor 15 relating to the first embodiment. The hydraulic motor 415 relating to the fifth embodiment is configured to apply a braking torque to the rotation restricting shaft 32, which is configured to oscillatorily rotate synchronously with the oscillatory rotating body 30. This means that the oscillatory rotating body 30 can be braked in a simplified manner while the hydraulic motor 415 is constituted by a smaller number of parts. Accordingly, the hydraulic motor 415 relating to the present embodiment can achieve a reduced cost.

Sixth Embodiment

Figure 13:
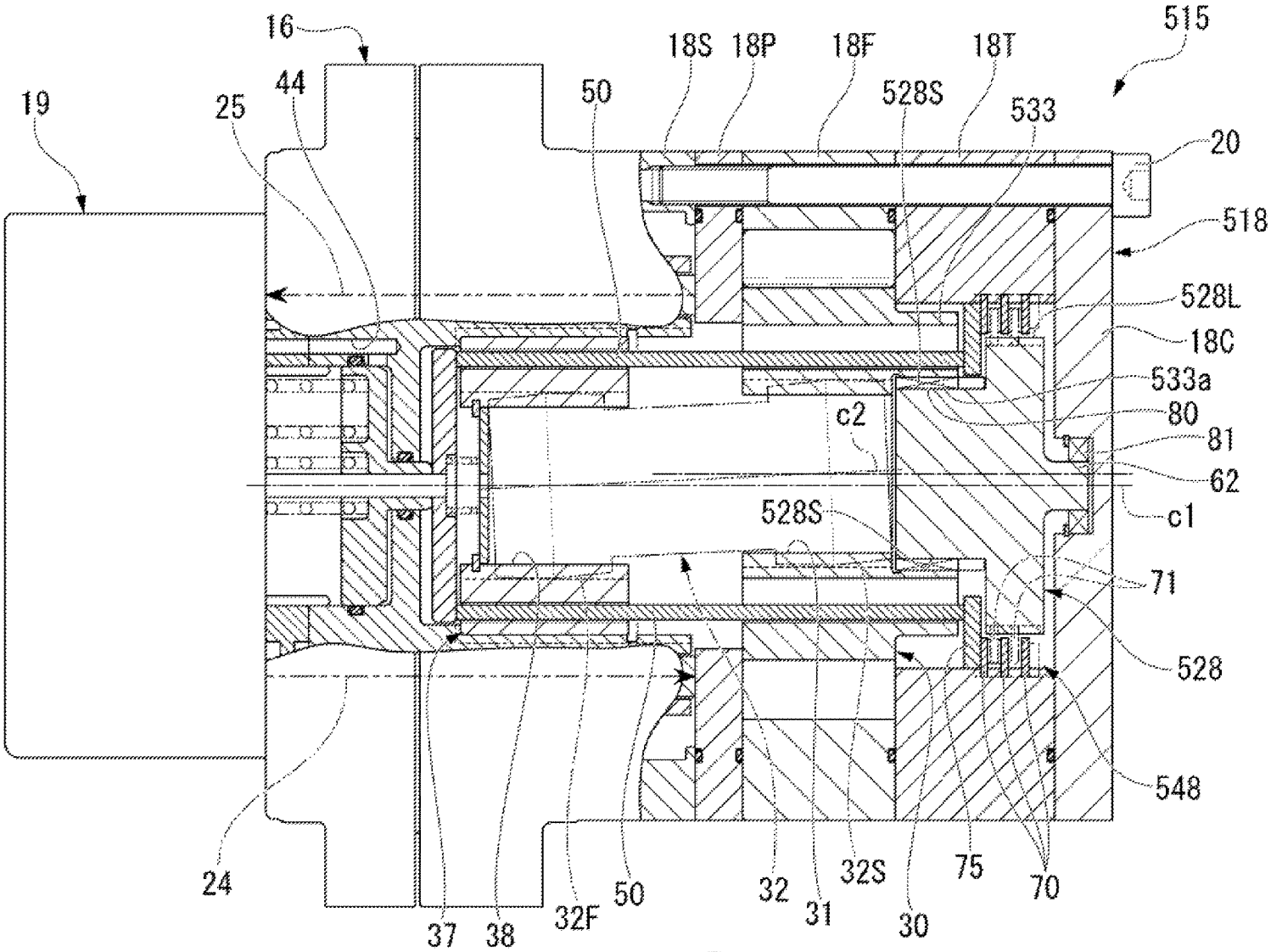
FIG. 13 is a vertical sectional view showing a hydraulic motor (hydraulic device) according to a sixth embodiment.
Figure 14:
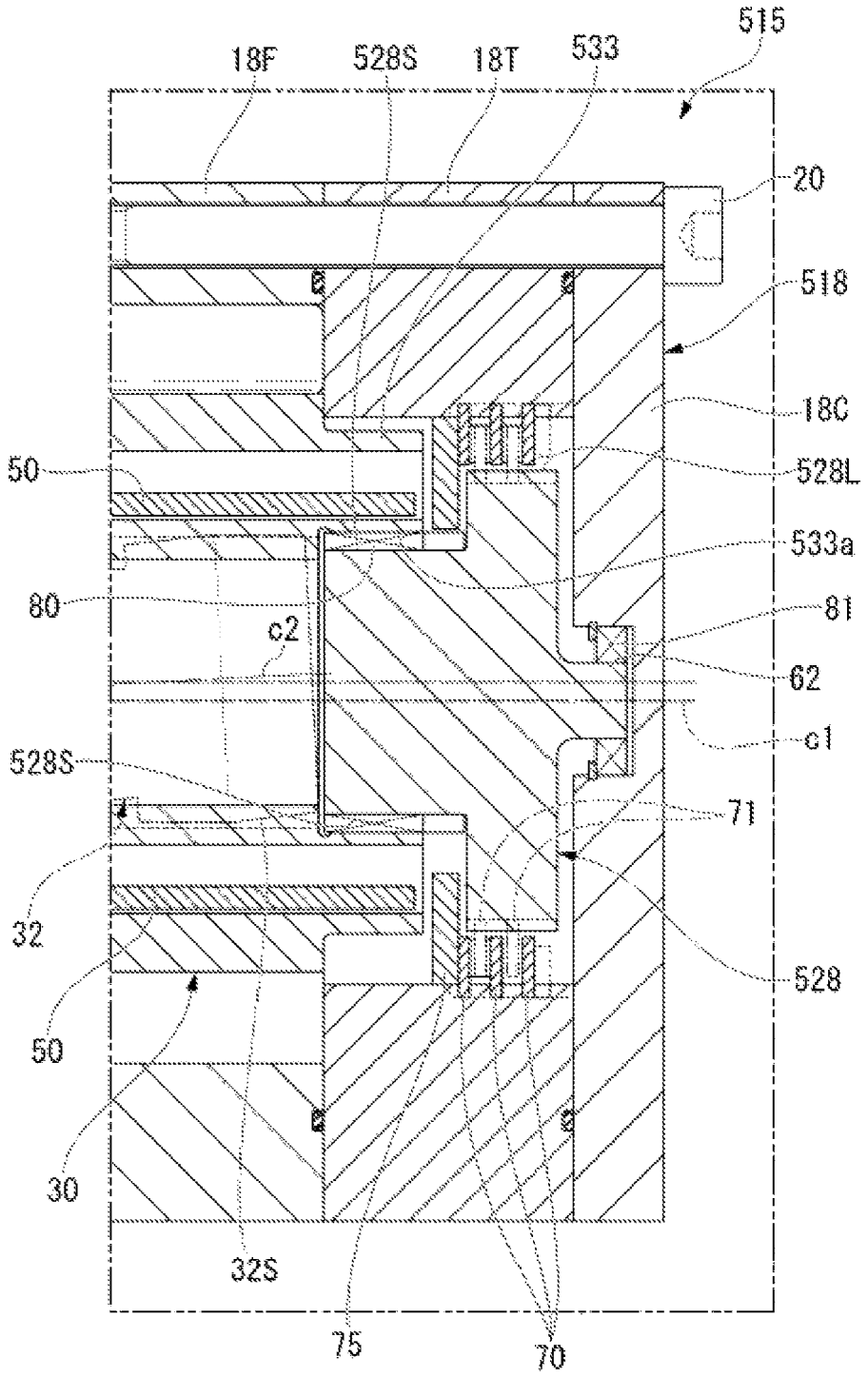
FIG. 14 is a vertical sectional view showing part of the hydraulic motor (hydraulic device) according to the sixth embodiment in a brake released state.

FIG. 13 is a vertical sectional view showing a hydraulic motor 515 (hydraulic device) according to a sixth embodiment. FIG. 14 is an enlarged view of the main part of FIG. 13 and shows how the hydraulic motor 515 works. FIG. 13 illustrates a brake mechanism 548 in operation. FIG. 14 illustrates the brake mechanism 548 suspended. Except for the brake mechanism 548, the hydraulic motor 515 relating to the sixth embodiment is partly configured in an analogous manner as the hydraulic motor 15 relating to the above-described first embodiment. The following description of the hydraulic motor 515 will be focused on the differences between the first and sixth embodiments.

The hydraulic motor 515 has an output rotatable block 518 constituted by the first tubular portion 18F, which is described in the first embodiment, and a third tubular portion 18T. The third tubular portion 18T is next to the first tubular portion 18F on the second direction side, and the end cover 18C is arranged on the end surface of the third tubular portion 18T facing the second direction. The end cover 18C, third tubular portion 18T, first tubular portion 18F, feeding and discharging plate 18P and second tubular portion 18S are combined together using a fastening bolt 20 to constitute the output rotatable block 518.

Inside the first tubular portion 18F, the oscillatory rotating body 30 is disposed such that it can oscillatorily rotate. The second tubular portion 18S is rotatably supported by the stationary block 16 via a bearing, which is not shown. A spline block 37 is seamlessly and fixedly provided on the inner circumferential portion of the stationary block 16. The oscillatory rotating body 30 and spline block 37 respectively have spline holes 31 and 38. The first external spline 32F of the first end of the rotation restricting shaft 32 is fitted in the spline hole 38 in the spline block 37 such that the rotation restricting shaft 32 can yaw. The second external spline 32S of the second end of the rotation restricting shaft 32 is fitted in the spline hole 31 in the oscillatory rotating body 30 such that the rotation restricting shaft 32 can yaw.

A rotation converting block 528 is housed inside the third tubular portion 18T. The rotation converting block 528 is configured to extract the oscillation component of the oscillatory rotating body 30 as the synchronous rotation about the first axis c1. The rotation converting block 528 includes a block body 528L and an eccentric boss 528S. The block body 528L has a large diameter and shaped like a short circular column. The eccentric boss 528S protrudes from the end surface of the block body 528L that faces the first direction. The eccentric boss 528S has a smaller diameter than the block body 528L and shaped like a short circular tube. The eccentric boss 528S is centered on a point shifted by a certain amount in the radial direction from the central axis of the bock body 528L (first axis c1). The amount of eccentricity of the eccentric boss 528S is substantially equal to the pivot radius (oscillation radius) of the oscillatory rotating body 30.

A boss 533 shaped like a circular tube protrudes toward the second direction from the inner circumferential edge of the oscillatory rotating body 30. The boss 533 of the oscillatory rotating body 30 protrudes in the axial direction into the inner space within the third tubular portion 18T. The inner circumferential surface of the boss 533 is referred to as a guide surface 533*a*. The eccentric boss 528S of the rotation converting block 528 is received by the guide surface 533*a* of the boss 533. The eccentric boss 528S is rotatably supported by the guide surface 533*a* via a bearing 80, which is a needle bearing or the like.

The rotation converting block 528, specifically, the block body 528L has a support boss 62 at the center of its end surface facing the second direction. The support boss 62 is shaped like a circular column and centered on the same axis as the block body 528L. The support boss 62 is rotatably supported by the end cover 18C of the output rotatable block 518 via a bearing 81. While the rotation converting block 528 is supported by the bearing 81, the block body 528L shaped like a short circular tube is rotatable about the first axis c1. The eccentric boss 528S is rotatable synchronously with the oscillatory rotation (eccentric rotation) of the oscillatory rotating body 30. The rotation converting block 528 can thus extract the oscillation component of the oscillatory rotating body 30 as the synchronous rotation about the first axis c1.

A plurality of second friction plates 70 shaped like a ring are attached to the inner circumferential surface of the third tubular portion 18T on the second direction side. The second friction plates 70 are mounted on the inner circumferential portion of the third tubular portion 18T such that they are movable in the axial direction but not allowed to rotate relative to the inner circumferential portion. Specifically, the inner circumferential surface of the third tubular portion 18T has a plurality of slit grooves along the axial direction, for example, and the second friction plates 70 have a plurality of claws on their outer circumferential portion. The claws are inserted in the slit grooves. The last second friction plate 70 on the second direction side is prevented from moving toward the second direction by a restricting member.

On the outer periphery of the block body 528L of the rotation converting block 528, a plurality of first friction plates 71 shaped like a ring are provided. The first friction plates 71 are mounted on the outer circumferential surface of the block body 528L such that they are movable in the axial direction but not allowed to rotate relative to the outer circumferential surface. Specifically, the outer periphery of the block body 528L has a plurality of slit grooves along the axial direction, for example. The first friction plates 71 have a plurality of claws on their inner circumferential portion. The claws are inserted in the slit grooves. The second and first friction plates 70 and 71 are alternately arranged in the axial direction. When an external force acts in the axial direction on the second and first friction plates 70 and 71, the second and first friction plates 70 and 71 establish a surface contact between them, thereby generating a braking force. In the present embodiment, the first friction plates 71 constitute the first friction plate configured to rotate together with the oscillatory rotating body 30. The second friction plates 70 constitute the second friction plate restricted from rotating by the second or first block. In the present embodiment, the second friction plates 70 are restricted from rotating by the output rotatable block 518 (third tubular portion 18T) serving as the first block.

The third tubular portion 18T having the second friction plates 70 attached thereto is part of the output rotatable block 518 configured to receive the reduced rotation. The rotation converting block 528 having the first friction plates 71 attached thereto is configured to rotate synchronously with the oscillatory rotation of the oscillatory rotating body 30. Therefore, the third tubular portion 18T and rotation converting block 528 always rotate at different speeds. For this reason, if a surface contact is established between the second and first friction plates 70 and 71 as described above and the braking force is thus exerted, the third tubular portion 18T and rotation converting block 528 are locked and the oscillatory rotation of the oscillatory rotating body 30 is locked.

The press mechanism constituting part of the brake mechanism 548 is configured in substantially the same manner as in the first embodiment. Note that, however, an end press plate 75 is provided on the inner periphery of the third tubular portion 18T to face the last second friction plate 70 on the first direction side. The end press plate 75 is configured to be pressed by the pressing rods 50 when they are biased by the bias spring 98 and to transmit the bias force produced by the bias spring 98 to the friction plates as the pressing force.

The hydraulic motor 515 relating to the sixth embodiment is slightly differently configured than the hydraulic motor 15 relating to the first embodiment but still can produce substantially the same effects as the hydraulic motor 15 relating to the first embodiment. In the hydraulic motor 515 relating to the sixth embodiment, the rotation converting block 528 and part of the brake mechanism 548 (the second and first friction plates 70 and 71 and the like) are provided on the second direction side with respect to the oscillatory rotating body 30. This arrangement may contradict the goal of achieving a shorter length in the axial direction. However, since the rotation converting block 528 and the main components of the brake mechanism are all contained inside the third tubular portion 18T, it is easy to employ a lot of common parts between the hydraulic motor 515 including the brake mechanism and the hydraulic motor without the brake mechanism. The sixth embodiment can thus achieve improved productivity.

Seventh Embodiment

Figure 15:
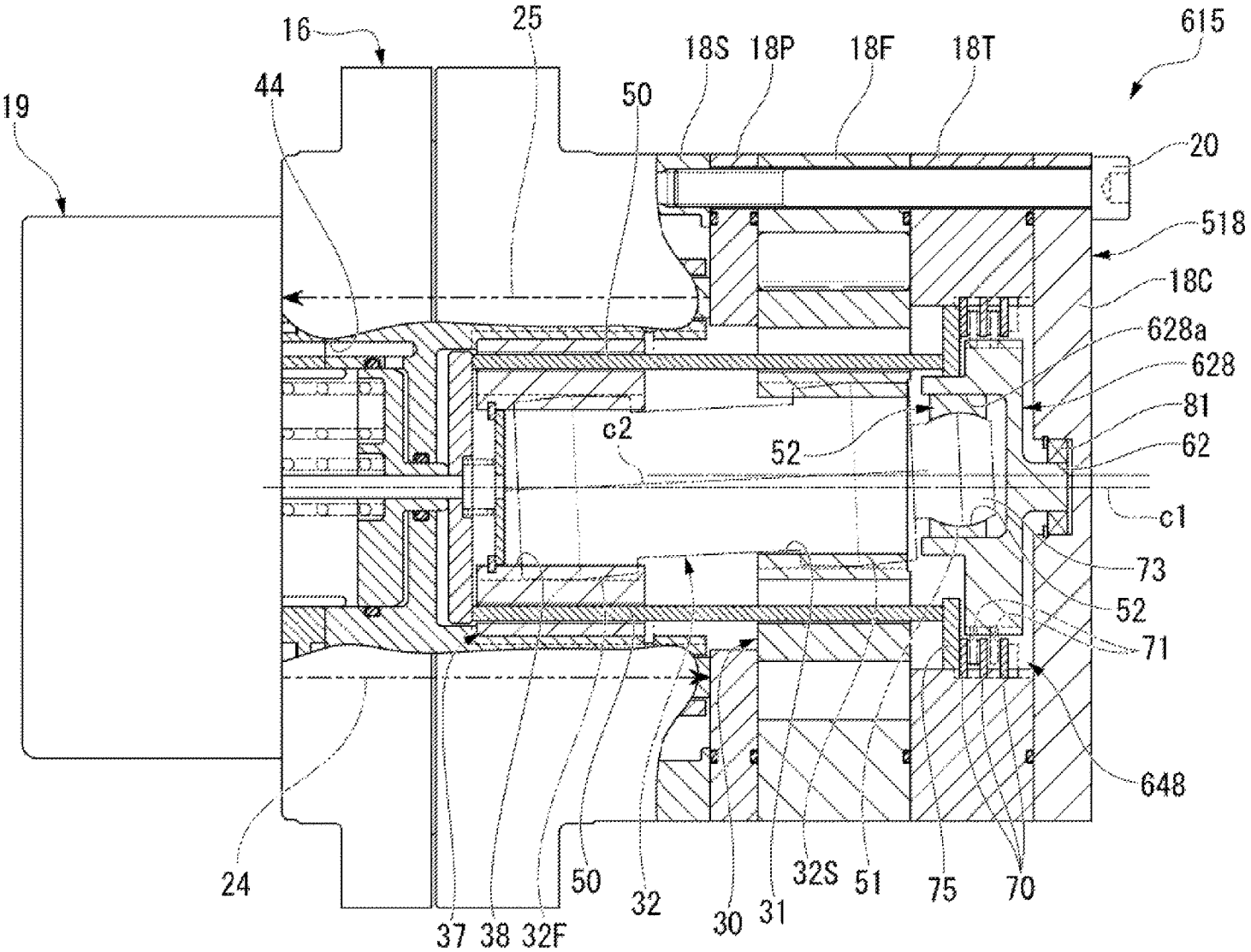
FIG. 15 is a vertical sectional view showing a hydraulic motor (hydraulic device) according to a seventh embodiment.

FIG. 15 is a vertical sectional view showing a hydraulic motor 615 (hydraulic device) according to a seventh embodiment. The hydraulic motor 615 relating to the present embodiment is basically configured in substantially the same manner as the hydraulic motor 515 relating to the above-described sixth embodiment. The seventh embodiment, however, is configured to extract the oscillation component of the oscillatory rotating body 30 as the synchronous rotation about the first axis c1 in a different manner than the sixth embodiment.

The end surface of the rotation restricting shaft 32 facing the second direction has a columnar protrusion 73 centered on the same axis as the rotation restricting shaft 32. The columnar protrusion 73 is seamlessly provided on the end surface. The protrusion 73 has a spherical raised portion 51 on its outer circumferential surface.

The rotation converting block 628 disposed inside the third tubular portion 18T has a circular eccentric hole 628*a* open toward the first direction. The eccentric hole 628*a* has a circular inner circumferential surface. The eccentric hole 628*a* is centered on a point shifted in the radial direction from the central axis of the rotation converting block 628 (first axis c1). The amount of eccentricity of the eccentric hole 628*a* relative to the central axis of the rotation converting block 628 is equal to the oscillation radius (eccentric rotation radius) of the raised portion 51 at the end of the rotation restricting shaft 32 facing the second direction. On the inner circumferential surface of the eccentric hole 628*a*, a plain bearing 52 is fixedly attached. The plain baring 52 has a recessed spherical inner surface. The spherically raised portion 51 of the rotation restricting shaft 32 is supported by the recessed spherical inner surface of the plain bearing 52 such that the rotation restricting shaft 32 can oscillate (yaw). In the present embodiment, the support boss 62 at the end surface of the rotation converting block 628 that faces the second direction is also supported by the end cover 18C via the bearing 81.

As in the sixth embodiment, a plurality of second friction plates 70 are attached to the inner circumferential surface of the third tubular portion 18T. On the outer circumferential surface of the rotation converting block 628, a plurality of first friction plates 71 are provided as in the sixth embodiment.

In the hydraulic motor 615 relating to the seventh embodiment, as the oscillatory rotating body 30 oscillatorily rotates, this causes the raised portion 51 of the rotation restricting shaft 32 at the end to synchronously oscillatorily rotate. The raised portion 51 slides in the plain bearing 52, and the oscillatory rotation component of the raised portion 51 is extracted as the rotation of the rotation converting block 628. In the hydraulic motor 615 relating to the seventh embodiment, the oscillation component of the oscillatory rotating body 30 is extracted as the synchronous rotation about the first axis c1 in a different manner than in the hydraulic motor 515 relating to the sixth embodiment. Except for this, the hydraulic motor 615 is configured in the same manner as the hydraulic motor 515. Therefore, the seventh embodiment can basically produce the same effects as the sixth embodiment.

In the hydraulic motor 615 relating to the present embodiment, the main constituents of the brake mechanism 648 and the rotation converting block 628 are all contained inside the third tubular portion 18T. Therefore, it is easy to employ a lot of common parts between the hydraulic motor 615 including the brake mechanism 648 and the hydraulic motor without the brake mechanism 648.

The present invention is not limited to the above-described embodiments, and various modifications can be made within the scope of the present invention.

The hydraulic devices relating to the foregoing embodiments are hydraulic motors, but the present invention is not limited to hydraulic motors. The hydraulic devices may be hydraulic pumps configured to pump out the hydraulic fluid in response to power applied from outside. In this case, the hydraulic pumps can be configured in substantially the same manner as in the foregoing embodiments. As the brake mechanism is provided in the same manner as in the foregoing embodiments, the oscillatory rotating body can be smoothly and reliably locked when the pump is suspended from operating, and the lock can be undone also smoothly and reliably.

The foregoing embodiments disclosed herein describe a plurality of physically separate constituent parts. They may be combined into a single part, and any one of them may be divided into a plurality of physically separate constituent parts. Irrespective of whether or not the constituent parts are integrated, they are acceptable as long as they are configured to attain the object of the invention.

What is claimed is:

1. A hydraulic device comprising:

a first block having a block inner circumferential portion and a plurality of internal teeth on the block inner circumferential portion;

a second block configured to rotate relative to the first block;

an oscillatory rotating body having a plurality of external teeth, the external teeth being smaller in number than the internal teeth, the oscillatory rotating body being provided inside the first block such that the oscillatory rotating body is oscillatorily rotatable, the oscillatory rotating body having an inner circumferential portion, the internal teeth and the external teeth defining a working chamber therebetween;

a rotation restricting shaft extending from the inner circumferential portion of the oscillatory rotating body in a direction intersecting a radial direction, the rotation restricting shaft coupling the oscillatory rotating body and the second block such that the oscillatory rotating body and the second block are not allowed to rotate relative to each other while allowing the oscillatory rotating body to oscillatorily rotate;

a first friction plate configured to rotate together with the oscillatory rotating body;

a second friction plate restricted from rotating by the second or first block; and a press mechanism configured to press the first and second friction plates against each other.

2. The hydraulic device of claim 1, wherein the first and second friction plates are shaped annularly, and wherein the first and second friction plates are disposed in a region surrounding the rotation restricting shaft.

3. The hydraulic device of claim 1, further comprises a rotation converting block configured to extract only a rotation component from oscillatory rotation of the oscillatory rotating body as a rotation about an axis of rotation of the first block, and configured to rotate synchronously with the rotation; and a bearing, wherein the first friction plate is supported by the rotation converting block such that the first friction plate is not allowed to rotate relative to the rotation converting block, and while being allowed to oscillatorily rotate, the oscillatory rotating body is supported by the first block via the rotation converting block and the bearing.

4. The hydraulic device of claim 1, wherein the oscillatory rotating body has an end surface, and wherein the first friction plate is attached to the end surface such that the first friction plate is not allowed to rotate relative to the oscillatory rotating body.

5. The hydraulic device of claim 1, wherein the first friction plate is attached to an outer periphery of the rotation restricting shaft such that the first friction plate is not allowed to rotate relative to the rotation restricting shaft.

6. The hydraulic device of claim 1, wherein the press mechanism includes:

a press member configured to apply a pressing force to the first and second friction plates;

a bias device configured to bias the press member in such a direction that the first and second friction plates frictionally touch each other; and a brake release device configured to move the press member in such a direction that frictional contact between the first and second friction plates is removed.

7. The hydraulic device of claim 6, wherein the brake release device is constituted by a piston device configured to move the press member in a friction removing direction using pressure produced by an introduced hydraulic fluid.

8. The hydraulic device of claim 7, wherein, as well as the first and second friction plates, the press member, the bias device and the piston device are disposed in a region surrounding the rotation restricting shaft.

9. A construction machine comprising:

a traveling drive unit; and a hydraulic motor configured to drive the traveling drive unit using a pressure produced by a hydraulic fluid, wherein the hydraulic motor is the hydraulic motor of claim 1.

10. The hydraulic device of claim 1, wherein the rotation restricting shaft is disposed while meshing with a spline hole in a spline block, which is disposed in a middle portion of the second block in the direction intersecting the radial direction, and meshing with a spline hole in the oscillatory rotating body, and wherein the spline block is seamlessly coupled with the second block.

11. The hydraulic device of claim 1, further comprises a brake mechanism configured to lock oscillatory rotation of the oscillatory rotating body, wherein a central axis of the second block coincides with an axis of rotation of the first block, an axial direction parallel to the central axis and the axis of rotation includes:

a first direction from the first block toward the second block; and a second direction from the second block toward the first block, wherein at least part of the brake mechanism is disposed in a region surrounding the rotation restricting shaft, wherein the brake mechanism includes:

the first friction plate;

the second friction plate; and the press mechanism, wherein the press mechanism includes:

a press member configured to apply a pressing force to the first and second friction plates;

a bias device configured to bias the press member in such the second direction that the first and second friction plates frictionally touch each other; and a brake release device configured to move the press member in such the first direction that frictional contact between the first and second friction plates is removed.

* * * * *